US010457062B2

(12) United States Patent
Okushima et al.

(10) Patent No.: US 10,457,062 B2
(45) Date of Patent: Oct. 29, 2019

(54) LIQUID DISCHARGE HEAD

(71) Applicant: CANON KABUSHIKI KAISHA, Tokyo (JP)

(72) Inventors: Shingo Okushima, Kawasaki (JP); Seiichiro Karita, Saitama (JP); Takatsuna Aoki, Yokohama (JP); Noriyasu Nagai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/398,546

(22) Filed: Jan. 4, 2017

(65) Prior Publication Data

US 2017/0197437 A1 Jul. 13, 2017

(30) Foreign Application Priority Data

Jan. 8, 2016 (JP) ..... 2016-002958
Dec. 8, 2016 (JP) ..... 2016-238632

(51) Int. Cl.
*B41J 2/18* (2006.01)
*B41J 2/175* (2006.01)
*B41J 2/14* (2006.01)

(52) U.S. Cl.
CPC ..... *B41J 2/18* (2013.01); *B41J 2/1404* (2013.01); *B41J 2/14024* (2013.01); *B41J 2/14072* (2013.01); *B41J 2/175* (2013.01); *B41J 2/17563* (2013.01); *B41J 2002/14467* (2013.01); *B41J 2202/12* (2013.01); *B41J 2202/19* (2013.01); *B41J 2202/20* (2013.01); *B41J 2202/21* (2013.01)

(58) Field of Classification Search
CPC ..... B41J 2/1404; B41J 2002/14467; B41J 2202/12
See application file for complete search history.

(56) References Cited

U.S. PATENT DOCUMENTS 6,019,907 A * 2/2000 Kawamura ..... B41J 2/1404 216/27
6,443,551 B1 * 9/2002 Matsumoto ..... B41J 2/005 347/100
7,267,431 B2 * 9/2007 Anderson ..... B41J 2/17513 347/20

(Continued)

FOREIGN PATENT DOCUMENTS

JP 2002-355973 A 12/2002

*Primary Examiner* — John Zimmermann
(74) *Attorney, Agent, or Firm* — Canon U.S.A., Inc. I.P. Division

(57) ABSTRACT

A liquid discharge head includes a recording element board including multiple discharge orifices configured to discharge liquid, multiple pressure chambers that communicate with the multiple discharge orifices via discharge channels, and have therein recording elements configured to generate energy used to discharge liquid, a liquid supply channel configured to supply liquid to the multiple pressure chambers, and a liquid recovery channel configured to recover liquid from, the multiple pressure chambers. The multiple pressure chambers communicate with the liquid supply channel and the liquid recovery channel so that liquid flows through the multiple pressure chambers. The direction of flow of liquid in the multiple pressure chambers is the same direction.

12 Claims, 34 Drawing Sheets

(56) References Cited

U.S. PATENT DOCUMENTS

| | | | | |
|---|---|---|---|---|
| 7,380,927 | B2 * | 6/2008 | Shigemura | B41J 2/1408 347/65 |
| 8,016,375 | B2 * | 9/2011 | Katoh | B41J 2/175 347/17 |
| 8,651,624 | B2 * | 2/2014 | Pan | B41J 2/1404 347/54 |
| 9,623,659 | B2 * | 4/2017 | Govyadinov | B41J 2/175 |
| 10,150,291 | B2 * | 12/2018 | Nakagawa | B41J 2/14032 |
| 2002/0008732 | A1 * | 1/2002 | Moon | B41J 2/1404 347/48 |
| 2010/0208010 | A1 * | 8/2010 | Inoue | B41J 2/14145 347/85 |
| 2011/0242214 | A1 * | 10/2011 | Kura | B41J 2/055 347/44 |
| 2012/0026262 | A1 * | 2/2012 | Shimizu | B41J 2/155 347/93 |
| 2018/0015723 | A1 * | 1/2018 | Yamazaki | B41J 2/14032 |

* cited by examiner

LIQUID DISCHARGE HEAD

BACKGROUND OF THE INVENTION

Field of the Invention

Aspects of the present invention relate to a liquid discharge head.

Description of the Related Art

There is a problem with liquid discharge heads that discharge liquid such as ink or the like from discharge orifices, in that volatile components in the liquid discharged from the discharge orifices evaporate, and the liquid thickens near the discharge orifices, resulting in change in discharge speed of discharged droplets, and droplet landing accuracy being affected.

There is a known method of circulating ink supplied to the liquid discharge head along a circulation path, as a measure to counter this liquid thickening phenomenon. Japanese Patent Laid-Open No. 2002-355973 describes a liquid discharge head that suppresses clogging of discharge orifices due to evaporation of liquid from the discharge orifices, by circulating liquid within a channel formed between a member where the discharge orifices are formed and a substrate where heating resistance elements are formed.

When intermission periods after discharge operations are long, increased viscosity of liquid nearby the discharge orifices is pronounced, and solid components within the liquid may solidify nearby the discharge orifices. Accordingly, the solid components may increase fluid resistance when the liquid passes through the discharge orifices at the time of the first liquid discharge after the intermission, which may result in a defective discharge.

However, no consideration regarding such defective discharge is given to the liquid discharge head described in Japanese Patent Laid-Open No. 2002-355973. Accordingly, the defective discharge occurring at the time of the first liquid discharge after the intermission may cause deterioration of image quality.

It has been found desirable to provide a liquid discharge apparatus and a liquid discharge head capable of high-definition and high-quality image formation.

SUMMARY OF THE INVENTION

A liquid discharge head includes a recording element board including first and second discharge orifice rows where discharge orifices configured to discharge liquid are arrayed, first and second pressure chamber rows provided corresponding to the first and second discharge orifice rows, and having recording elements configured to generate energy used to discharge liquid, a first liquid supply channel configured to supply liquid to the first pressure chamber row and a first liquid recovery channel configured to recover liquid from the first pressure chamber row, and a second liquid supply channel configured to supply liquid to the second pressure chamber row and a second liquid recovery channel configured to recover liquid from the second pressure chamber row. The first liquid supply channel, the first liquid recovery channel, the second first liquid supply channel, and the second liquid recovery channel, are provided in parallel in that order. A direction of flow of liquid within each of the plurality of pressure chambers included in the first and second pressure chamber rows, from the liquid supply channel via the pressure chamber and to the liquid recovery channel, is the same direction.

Further features of the present invention will become apparent from the following description of exemplary embodiments with reference to the attached drawings.

DESCRIPTION OF THE EMBODIMENTS

Embodiments will be described below with reference to the attached drawings. It should be understood, however, that the description that follows does not restrict the scope of the present invention. As one example, a thermal system where bubbles are generated by heat-generating elements and liquid is discharged is implied in the embodiments, but the present invention is applicable to liquid discharge head employing piezoelectric systems or various other types of liquid discharge systems as well. Note that the liquid discharge head according to an embodiment of the present invention that discharges liquid such as ink and the like, and the liquid discharge apparatus to which the liquid discharge head is mounted, are applicable to apparatuses such as printers, photocopiers, facsimile devices having communication systems, word processors having printer units, and so forth, and further to industrial recording apparatuses combined in a complex manner with various types of processing devices. For example, an embodiment of the present invention can be used in fabricating biochips, printing electronic circuits, fabricating semiconductor substrates, and other such usages.

Although the embodiments relate to an inkjet recording apparatus (or simply "recording apparatus") of a form where a liquid such as ink or the like is circulated between a tank and liquid discharge head, other forms may be used as well. For example, a form may be employed where, instead of circulating ink, two tanks are provided, one at the upstream side of the liquid discharge head and the other on the downstream side, and ink within the pressure chamber is caused to flow by running ink from one tank to the other. Also, the embodiments relate to a so-called line (page-wide) head that has a length corresponding to the width of the recording medium, but the embodiment of present invention can also be a so-called serial liquid discharge head that records while scanning over the recording medium. An example of a serial liquid discharge head is one that has one board each for recording black ink and for recording color ink, but this is not restrictive. An arrangement may be made where short line heads that are shorter than the width of the recording medium are formed, with multiple recording element boards arrayed so that orifices overlap in the discharge orifice row direction, these being scanned over the recording medium.

First Embodiment

Description of Inkjet Recording Apparatus

Figure 1:
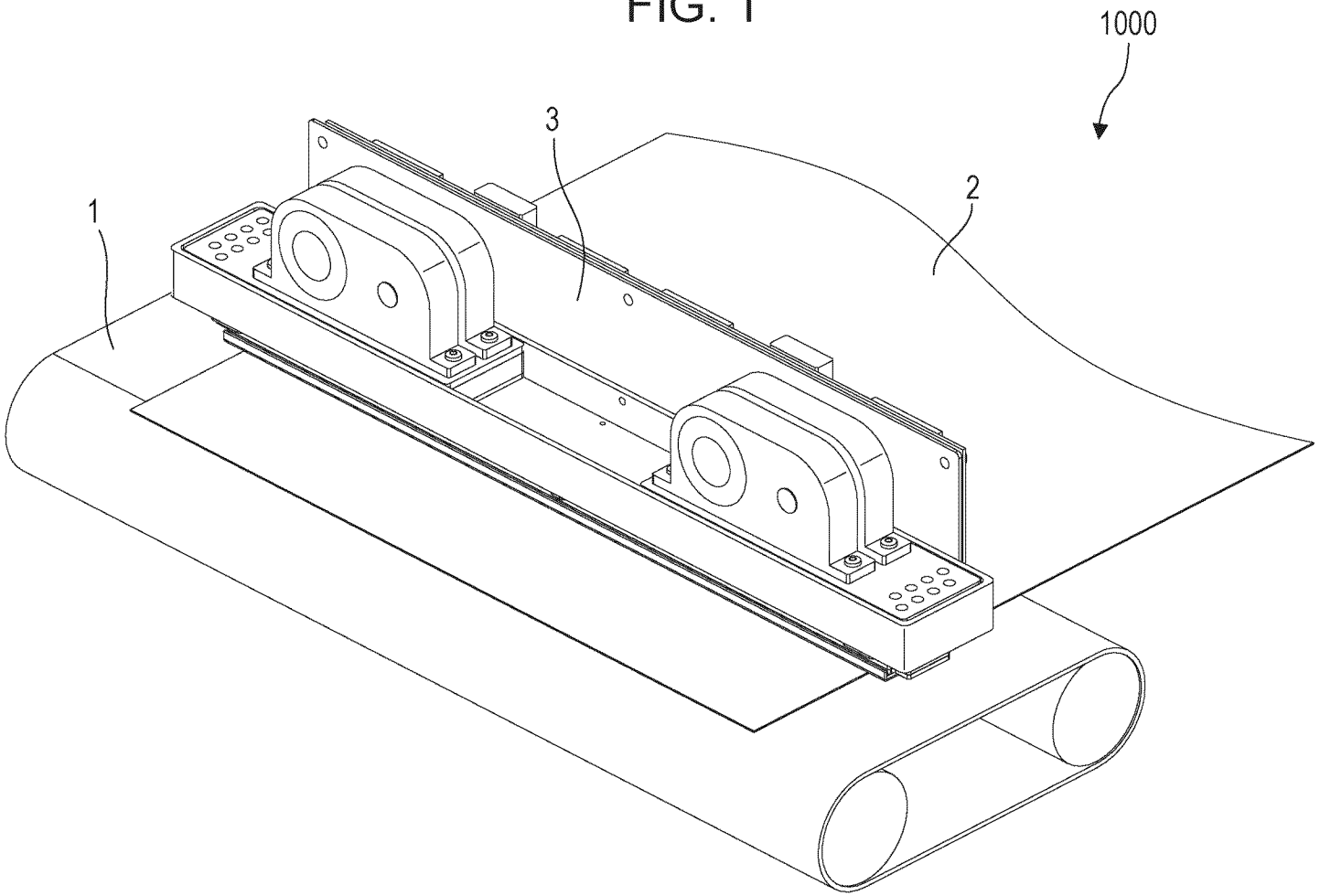
FIG. 1 is a perspective view illustrating an inkjet recording apparatus according to a first embodiment.

FIG. 1 illustrates a schematic configuration of a device that discharges liquid, and more particularly an inkjet recording apparatus 1000 (hereinafter also referred to simply as "recording apparatus") that performs recording by discharging ink. The recording apparatus 1000 is a line recording apparatus that has a conveyance unit 1 that conveys a recording medium 2, and a line type liquid discharge head 3 disposed generally orthogonal to the conveyance direction of the recording medium 2, and performs single-pass continuous recording while continuously or intermittently conveying multiple recording mediums 2. The recording medium 2 is not restricted to cut sheets, and may be continuous roll sheets. The liquid discharge head 3 is capable of full-color printing by cyan, magenta, yellow, and black (acronym "CMYK") ink. The liquid discharge head 3 has a liquid supply unit serving as a supply path that supplies liquid to the liquid discharge head 3, a main tank, and a buffer tank (see FIG. 2) connected by fluid connection, which will be described later. The liquid discharge head 3 is also electrically connected to an electric control unit that transmits electric power and discharge control signals to the liquid discharge head 3. Liquid paths and electric signal paths within the liquid discharge head 3 will be described later.

Description of First Circulation Path

Figure 2:
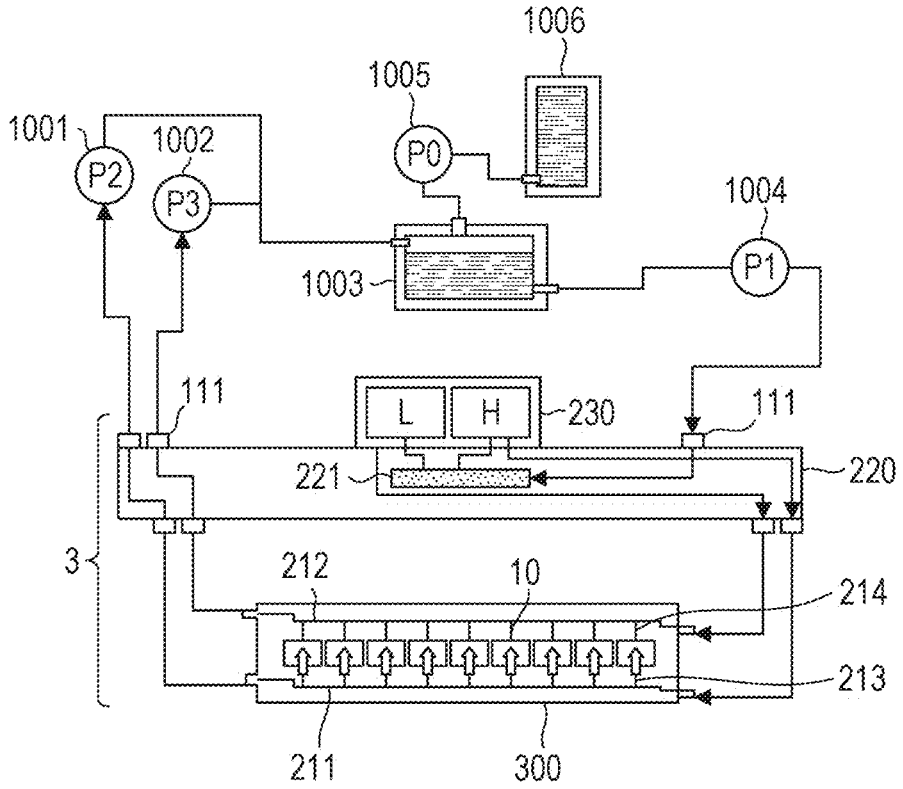
FIG. 2 is a schematic diagram illustrating a first circulation path in the first embodiment.

FIG. 2 is a schematic diagram illustrating a first circulation path that is a first form of a circulation path applied to the recording apparatus of the present embodiment. FIG. 2 is a diagram illustrating a first circulation pump (high-pressure side) 1001, a first circulation pump (low-pressure side) 1002, and a buffer tank 1003 and the like, connected to the liquid discharge head 3 by fluid connection. Although FIG. 2 only illustrates the paths over which one color ink out of the CMYK ink flows, for the sake of brevity of description, in reality there are four colors worth of circulation paths provided to the liquid discharge head 3 and the recording apparatus main unit. The buffer tank 1003, serving as a sub-tank that is connected to a main tank 1006, has an atmosphere communication opening (omitted from illustration) whereby the inside and the outside of the tank communicate, and bubbles within the ink can be discharged externally. The buffer tank 1003 is also connected to a replenishing pump 1005. When ink is consumed at the liquid discharge head 3 due to discharging (ejecting) ink from the discharge orifices of the liquid discharge head, by discharging ink to perform recording, suction recovery, or the like, the replenishing pump 1005 acts to send ink of an amount the same as that has been consumed from the main tank 1006 to the buffer tank 1003.

The first circulation pumps 1001 and 1002 act to extract liquid from a fluid connector 111 of the liquid discharge head 3 and flow the liquid to the buffer tank 1003. The first circulation pumps preferably are positive-displacement pumps that have quantitative fluid sending capabilities. Specific examples may include tube pumps, gear pumps, diaphragm pumps, syringe pumps, and so forth. An arrangement may also be used where a constant flow is ensured by disposing a common-use constant-flow value and relief valve at the outlet of the pump. When the liquid discharge unit 300 is being driven, the first circulation pump (high-pressure side) 1001 and first circulation pump (low-pressure side) 1002 cause a constant amount of ink to flow through a common supply channel 211 and a common recovery channel 212. The amount of flow is preferably set to a level where temperature difference among recording element boards 10 of the liquid discharge head 3 does not influence recording image quality, or higher. On the other hand, if the flow rate is set excessively high, the effects of pressure drop in the channels within a liquid discharge unit 300 causes excessively large difference in negative pressure among the recording element boards 10, resulting in unevenness in density in the image. Accordingly, the flow rate is preferably set taking into consideration temperature difference and negative pressure difference among the recording element boards 10.

A negative pressure control unit 230 is provided between paths of a second circulation pump 1004 and the liquid discharge unit 300. The negative pressure control unit 230 functions such that the pressure downstream from the negative pressure control unit 230 (i.e., at the liquid discharge unit 300 side) can be maintained at a present constant pressure even in cases where the flow rate of the circulation system fluctuates due to difference in duty when recording. Any mechanism may be used as two pressure adjustment mechanisms making up the negative pressure control unit 230, as long as pressure downstream from itself can be controlled to fluctuation within a constant range or smaller that is centered on a desired set pressure. As one example, a mechanism equivalent to a so-called "pressure-reducing regulator" can be employed. In a case of using a pressure-reducing regulator, the upstream side of the negative pressure control unit 230 is preferably pressurized by the second circulation pump 1004 via a liquid supply unit 220, as illustrated in FIG. 2. This enables the effects of water head pressure as to the liquid discharge head 3 of the buffer tank 1003 as to the liquid discharge head 3 to be suppressed, giving broader freedom in the layout of the buffer tank 1003 in the recording apparatus 1000. It is sufficient that the second circulation pump 1004 have a certain lift pressure or greater, within the range of the circulatory flow pressure of ink used when driving the liquid discharge head 3, and turbo pumps, positive-displacement pumps, and the like can be used. Specifically, diaphragm pumps or the like can be used. Alternatively, a water head tank disposed with a certain water head difference as to the negative pressure control unit 230, for example, may be used instead of the second circulation pump 1004.

As illustrated in FIG. 2, the negative pressure control unit 230 has two pressure adjustment mechanisms, with different control pressure from each other having been set. Of the two negative pressure adjustment mechanisms, the relatively high-pressure setting side (denoted by H in FIG. 2) and the relatively low-pressure side (denoted by L in FIG. 2) are respectively connected to the common supply channel 211 and the common recovery channel 212 within the liquid discharge unit 300 via the liquid supply unit 220. Provided to the liquid discharge unit 300 are individual supply channels 213 and individual recovery channels 214 communicating between the common supply channel 211, common recovery channel 212, and the recording element boards 10. Due to the individual supply channels 213 communicating with the common supply channel 211 and common recovery channel 212, flows occur where part of the liquid flows from the common supply channel 211 through internal channels in the recording element board 10 and to the common recovery channel 212 (indicated by the arrows in FIG. 2). The reason is that the pressure adjustment mechanism H is connected to the common supply channel 211, and the pressure adjustment mechanism L to the common recovery channel 212, so a pressure difference is generated between the two common channels.

Thus, flows occur within the liquid discharge unit 300 where a part of the liquid passes through the recording element boards 10 while liquid flows through each of the common supply channel 211 and common recovery channel 212. Accordingly, heat generated at the recording element boards 10 can be externally discharged from the recording element boards 10 by the flows through the common supply channel 211 and common recovery channel 212. This configuration also enables ink flows to be generated at discharge orifices and pressure chambers not being used for recording while recording is being performed by the liquid discharge head 3, so thickening of the ink at such portions can be suppressed. Further, thickened ink and foreign substances in the ink can be discharged to the common recovery channel 212. Accordingly, the liquid discharge head 3 according to the present embodiment can record at high speed with high image quality.

Description of Second Circulation Path

Figure 3:
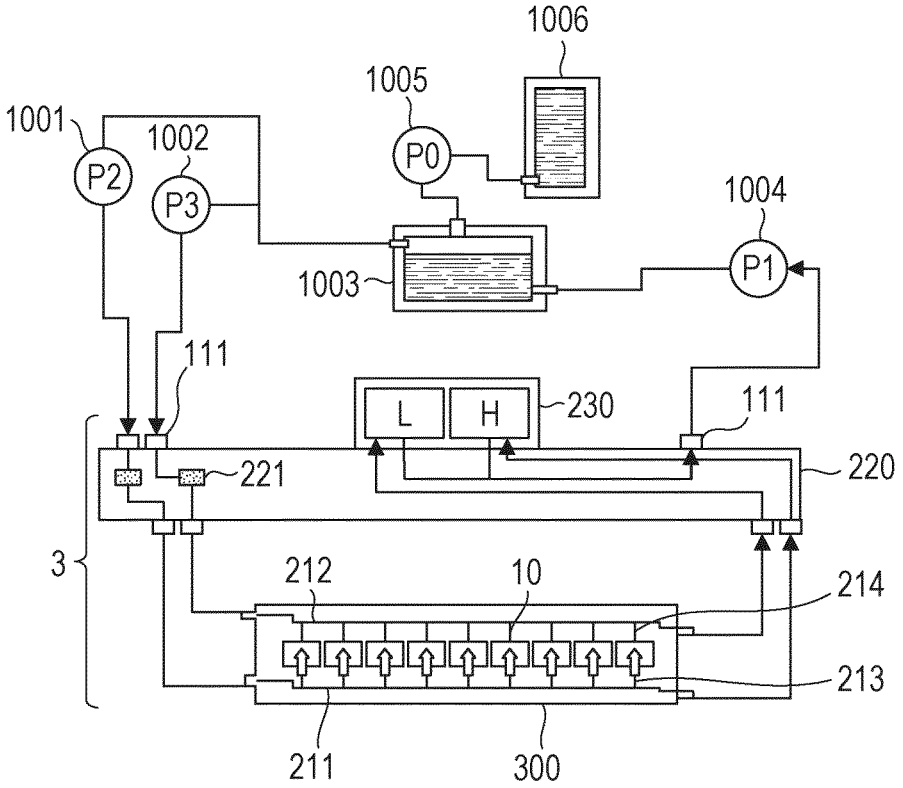
FIG. 3 is a schematic diagram illustrating a second circulation path in the first embodiment.

FIG. 3 illustrates, of circulation paths applied to the recording apparatus according to the present embodiment, a second circulation path that is a different circulation path from the above-described first circulation path. A primary point of difference as to the above-described first circulation path is that both of the two pressure adjustment mechanisms making up the negative pressure control unit 230 have a mechanism to control pressure at the upstream side from the negative pressure control unit 230 to fluctuation within a constant range that is centered on a desired set pressure. This mechanism is a mechanism part having operations equivalent to a so-called "backpressure regulator". Another point of difference is that the second circulation pump 1004 acts as a negative pressure source to depressurize the downstream side from the negative pressure control unit 230. A further point of difference is that the first circulation pump (high-pressure side) 1001 and first circulation pump (low-pressure side) 1002 are disposed on the upstream side of the liquid discharge head 3, and the negative pressure control unit 230 is disposed on the downstream side of the liquid discharge head 3.

The negative pressure control unit 230 in the second circulation path acts as follows. That is to say, the negative pressure control unit 230 operates to maintain pressure fluctuation on the upstream side of itself (i.e., at the liquid discharge unit 300 side) within a constant range centered on a preset pressure, even in cases where the flow rate fluctuates due to difference in duty when recording with the liquid discharge head 3. The downstream side of the negative pressure control unit 230 is preferably pressurized by the second circulation pump 1004 via the liquid supply unit 220, as illustrated in FIG. 3. This enables the effects of water head of the buffer tank 1003 as to the liquid discharge head 3 to be suppressed, giving a broader range of selection for the layout of the buffer tank 1003 in the recording apparatus 1000. Alternatively, a water head tank disposed with a certain water head difference as to the negative pressure control unit 230, for example, may be used instead of the second circulation pump 1004.

The negative pressure control unit 230 has two pressure adjustment mechanisms, with different control pressure from each other having been set as illustrated in FIG. 3, in the same way as the first embodiment. Of the two negative pressure adjustment mechanisms, the relatively high-pressure setting side (denoted by H in FIG. 3) and the relatively low-pressure side (denoted by L in FIG. 3) are respectively connected to the common supply channel 211 and the common recovery channel 212 within the liquid discharge unit 300 via the liquid supply unit 220. The pressure of the common supply channel 211 is made to be relatively higher than the pressure of the common recovery channel 212 by the two negative pressure adjustment mechanisms. Thus, flows occur where ink flows from the common supply channel 211 through individual channels 213 and 214 and internal channels in the recording element board 10 to the common recovery channel 212 (indicated by the arrows in FIG. 3). The second circulation path thus yields an ink flow state the same as that of the first circulation path within the liquid discharge unit 300, but has two advantages that are different from the case of the first circulation path.

One advantage is that, with the second circulation path, the negative pressure control unit 230 is disposed on the downstream side of the liquid discharge head 3, so there is little danger that dust and foreign substances generated at the negative pressure control unit 230 will flow into the head. A second advantage is that the maximum value of the necessary flow rate supplied from the buffer tank 1003 to the liquid discharge head 3 can be smaller in the second circulation path as compared to the case of the first circulation path. The reason is as follows. The total flow rate within the common supply channel 211 and common recovery channel 212 when circulating during recording standby will be represented by A. The value of A is defined as the smallest flow rate necessary to maintain the temperature difference in the liquid discharge unit 300 within a desired range in a case where temperature adjustment of the liquid discharge head 3 is performed during recording standby. Also, the discharge flow rate in a case of discharging ink from all discharge orifices of the liquid discharge unit 300 (full discharge) is defined as F. Accordingly, in the case of the first circulation path (FIG. 2), the set flow rate of the first circulation pump (high-pressure side) 1001 and the first circulation pump (low-pressure side) 1002 is A, so the maximum value of the liquid supply amount to the liquid discharge head 3 necessary for full discharge is A+F.

On the other hand, in the case of the second circulation path (FIG. 3), the liquid supply amount to the liquid discharge head 3 necessary at the time of recording standby is flow rate A. This means that the supply amount to the liquid discharge head 3 that is necessary for full discharge is flow rate F. Accordingly, in the case of the second circulation path, the total value of the set flow rate of the first circulation pump (high-pressure side) 1001 and the first circulation pump (low-pressure side) 1002, i.e., the maximum value of the necessary supply amount, is the larger value of A and F. Thus, the maximum value of the necessary supply amount in the second circulation path (A or F) is always smaller than the maximum value of the necessary supply amount in the first circulation path (A+F), as long as the liquid discharge unit 300 of the same configuration is used. Consequently, the degree of freedom regarding circulatory pumps that can be applied is higher in the case of the second circulation path, so low-cost circulatory pumps having a simple structure can be used, the load on a cooler (omitted from illustration) disposed on the main unit side path can be reduced, for example. Accordingly, costs of the recording apparatus main unit can be reduced. This advantage is more pronounced with line heads where the values of A or F are relatively great, and is more useful the longer the length of the line head is in the longitudinal direction.

However, there are points where the first circulation path is more advantageous than the second circulation path. That is to say, with the second circulation path, the flow rate flowing through the liquid discharge unit 300 at the time of recording standby is maximum, so the lower the recording duty of the image is, the greater a negative pressure is applied to the nozzles. Accordingly, in a case where the channel widths of the common supply channel 211 and common recovery channel 212 (the length in a direction orthogonal to the direction of flow of liquid) is reduced to reduce the head width (the length of the liquid discharge head in the transverse direction), this may result in more influence of satellite droplets. The reason is that high negative pressure is applied to the nozzles in low-duty images where unevenness is conspicuous. On the other hand, high negative pressure is applied to the nozzles when forming high-duty images in the case of the first circulation path, so any generated satellites are less conspicuous, which is advantageous in that influence on the image quality is small. Which of these two circulation paths is more preferable can be selected in light of the specifications of the liquid discharge head and recording apparatus main unit (discharge flow rate F, smallest circulatory flow rate A, and channel resistance within the head).

Description of Configuration of Liquid Discharge Head

Figure 4A:
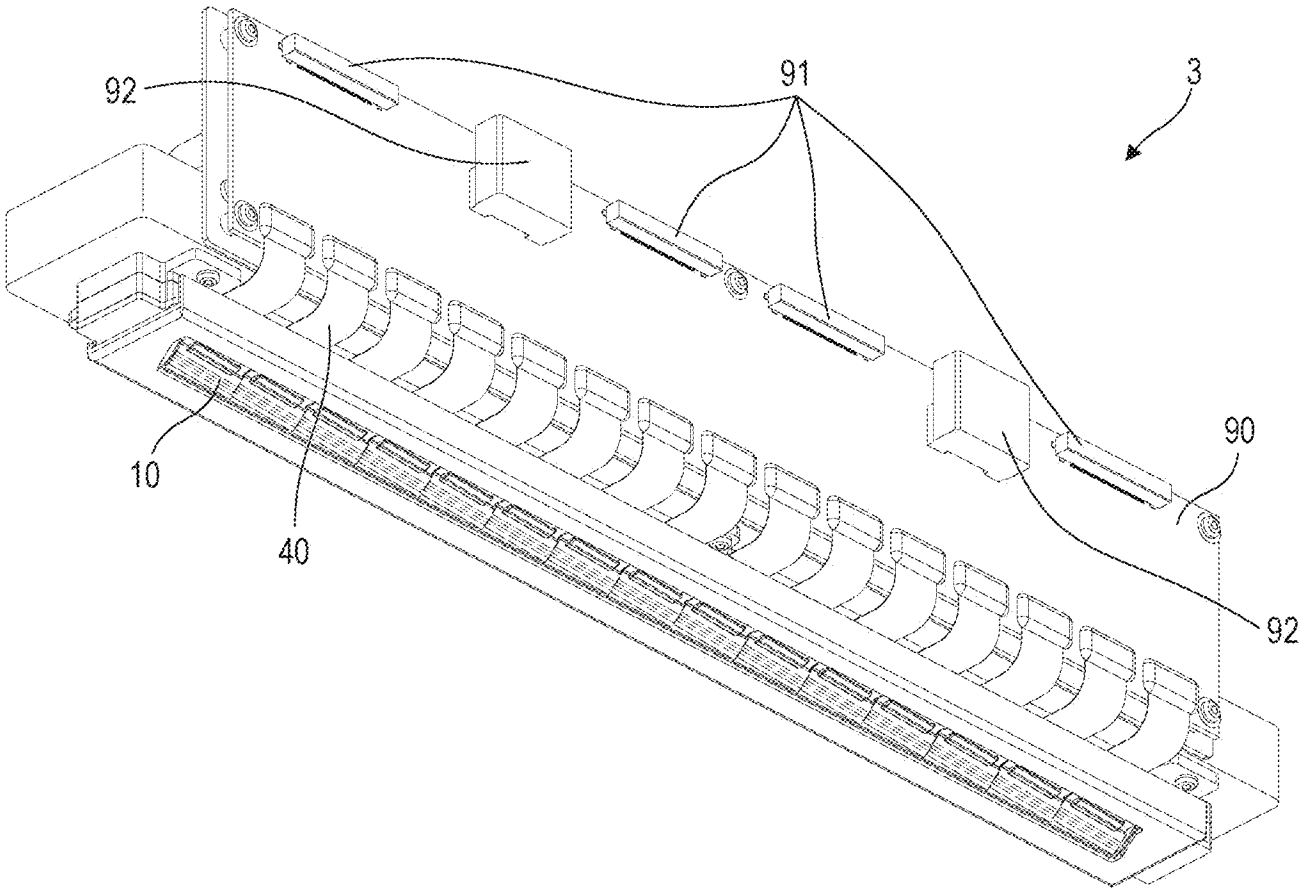
FIGS. 4A and 4B are perspective diagrams of a liquid discharge head according to the first embodiment.
Figure 4B:
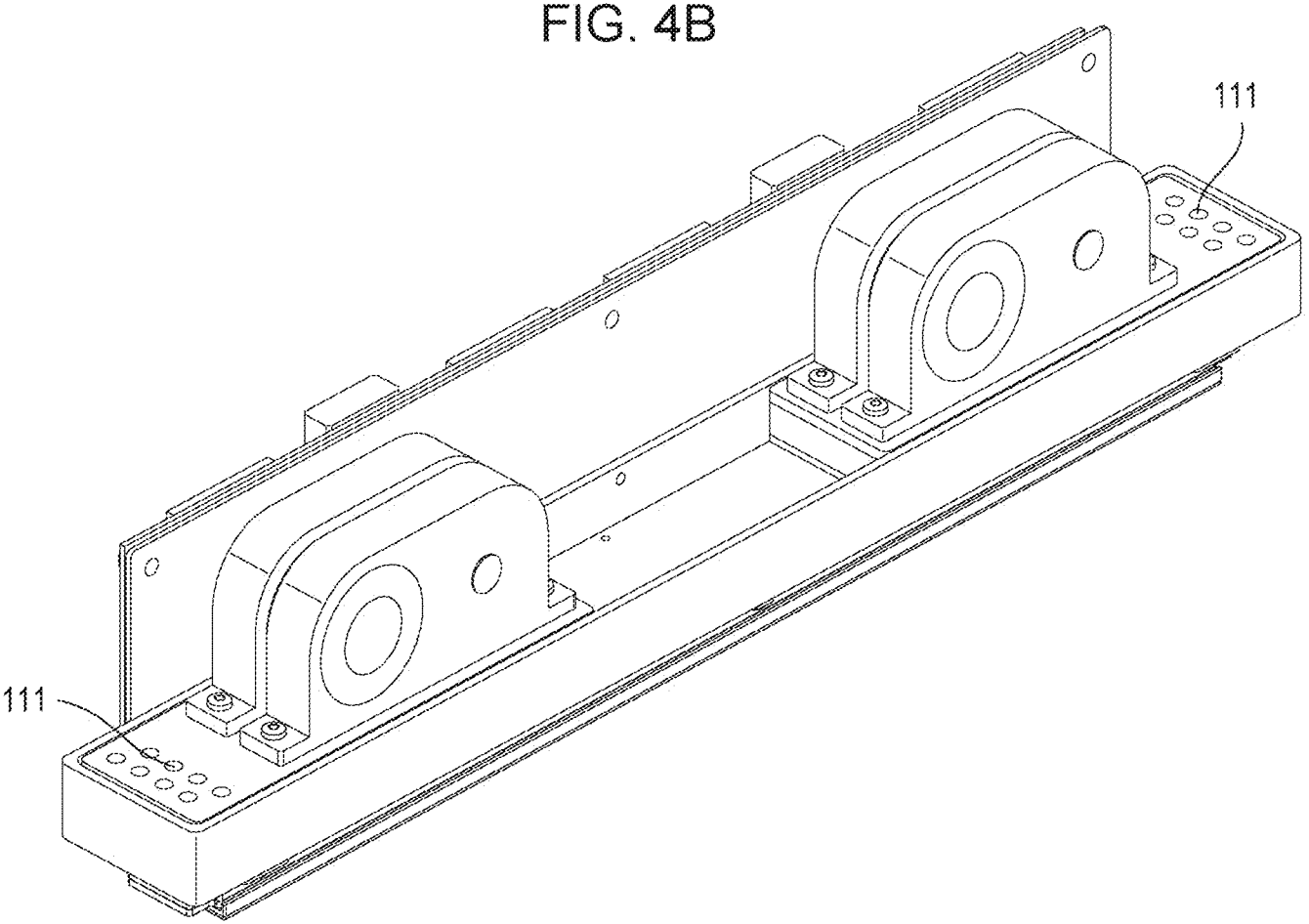

The configuration of the liquid discharge head 3 according to the first embodiment will be described. FIGS. 4A and 4B are perspective views of the liquid discharge head 3 according to the present embodiment. The liquid discharge head 3 is a line-type liquid discharge head where fifteen recording element boards 10, each recording element board 10 capable of discharging ink of the four colors of C, M, Y, and K, are arrayed on a straight line (inline layout). The liquid discharge head 3 includes the recording element boards 10, and input terminals 91 and power supply terminals 92 that are electrically connected via flexible printed circuit boards 40 and an electric wiring board 90, as illustrated in FIG. 4A. The input terminals 91 and power supply terminals 92 are electrically connected to a control unit of the recording apparatus 1000, and each supply the recording element boards 10 with discharge drive signals and electric power necessary for discharge. Consolidating wiring by electric circuits in the electric wiring board 90 enables the number of input terminals 91 and power supply terminals 92 to be reduced in comparison with the number of recording element boards 10. This enables the number of electric connection portions that need to be removed when assembling the liquid discharge head 3 to the recording apparatus 1000 or when exchanging the liquid discharge head 3. Liquid connection portions 111 provided to both ends of the liquid discharge head 3 are connected with the liquid supply system of the recording apparatus 1000, as illustrated in FIG. 4B. Thus, ink of the four colors of CMYK is supplied to the liquid discharge head 3, and ink that has passed through the liquid discharge head 3 is recovered to the supply system of the recording apparatus 1000. In this way, ink of each color can circulate over the path of the recording apparatus 1000 and the path of the liquid discharge head 3.

Figure 5:
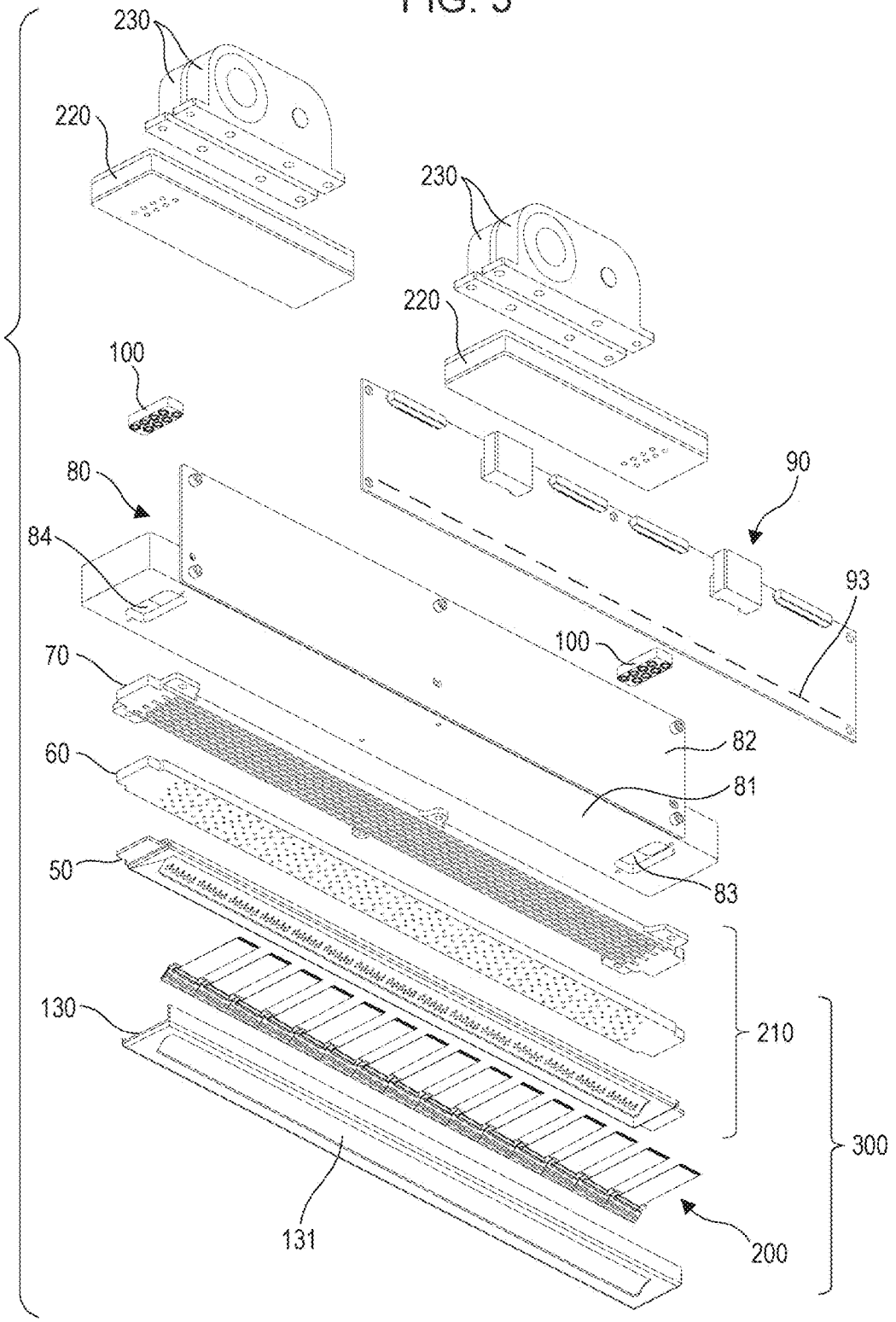
FIG. 5 is a disassembled perspective view of the liquid discharge head according to the first embodiment.

FIG. 5 illustrates a disassembled perspective view of parts and units making up the liquid discharge head 3. The liquid discharge unit 300, liquid supply units 220, and electric wiring board 90 are attached to a case 80. The liquid connection portions 111 (FIG. 3) are provided to the liquid supply unit 220, and filters 221 (FIGS. 2 and 3) for each color, that communicate with each opening of the liquid connection portions 111 to remove foreign substances in the supplied ink, are provided inside the liquid supply units 220. Two liquid supply units 220 are each provided with filters 221 for two colors. The liquids that have passed through the filters 221 are supplied to the negative pressure control units 230 for the respective colors, provided on the corresponding liquid supply units 220. Each negative pressure control unit 230 is a unit made up of a pressure adjustment value for its respective color, and markedly attenuate change in pressure drop in the supply system of the recording apparatus 1000 (supply system on the upstream side of the liquid discharge head 3) occurring due to fluctuation in the flow rate of liquid, by the operations of valve and spring members and the like therein. Accordingly, the negative pressure control units 230 are capable of stabilizing change of negative pressure at the downstream side from themselves (liquid discharge unit 300 side) within a certain range. Each negative pressure control unit 230 for each color has two pressure adjustment values built in, as described in FIG. 2. These two pressure adjustment values are each set to different control pressures, and communicate with the liquid supply unit 220 via the common supply channel 211 in the liquid discharge unit 300 in the case of the high-pressure side and via the common recovery channel 212 in the case of the low-pressure side.

The case 80 is configured including a liquid discharge unit support member 81 and electric wiring board support member 82, and supports the liquid discharge unit 300 and electric wiring board 90 as well as securing rigidity of the liquid discharge head 3. The electric wiring board support member 82 is for supporting the electric wiring board 90, and is fixed by being screwed to the liquid discharge unit support member 81. The liquid discharge unit support member 81 serves to correct warping and deformation of the liquid discharge unit 300, and thus secure relative positional accuracy of the multiple recording element boards 10, thereby suppressing unevenness the recorded article. Accordingly, the liquid discharge unit support member 81 preferably has sufficient rigidity. Examples of suitable materials include metal materials such as stainless steel and aluminum, and ceramics such as alumina. The liquid discharge unit support member 81 has openings 83 and 84 into which joint rubber members 100 are inserted. Liquid supplied from a liquid supply unit 220 passes through a joint rubber member 100 and is guided to a third channel member 70 which is a part making up the liquid discharge unit 300.

The liquid discharge unit 300 is made up of multiple discharge modules 200 and a channel member 210, and a cover member 130 is attached to the face of the liquid discharge unit 300 that faces the recording medium. The cover member 130 is a member having a frame-shaped face where a long opening 131 is provided. The recording element boards 10 included in the discharge module 200 and a sealing portion 110 made up of a sealant (FIG. 9A) are exposed from the opening 131, as illustrated in FIG. 5. The frame portion on the perimeter of the opening 131 functions as a contact surface for a cap member that caps off the liquid discharge head 3 when in recording standby. Accordingly, a closed space is preferably formed when capping, by coating the perimeter of the opening 131 with an adhesive agent, sealant, filling member, or the like, to fill in roughness and gaps on the discharge orifice face of the liquid discharge unit 300.

Next, description will be made regarding the configuration of the channel member 210 included in the liquid discharge unit 300. The channel member 210 is an article formed by laminating a first channel member 50, a second channel member 60, and the third channel member 70. The channel member 210 is a channel member that distributes the liquid supplied from the liquid supply unit 220 to each of the discharge modules 200, and returns liquid recirculating from the discharge modules 200 to the liquid supply unit 220. The channel member 210 is fixed to the fluid discharge unit support member 81 by screws, thereby suppressing warping and deformation of the channel member 210.

Figure 6A:
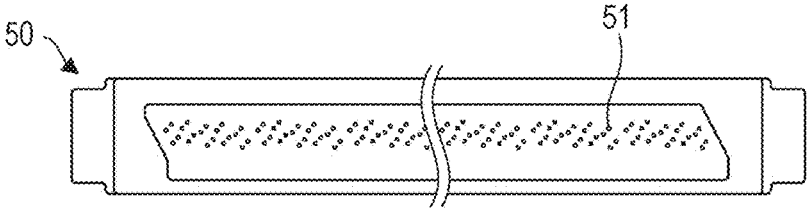
FIGS. 6A through 6F are plan views illustrating first through third channel members according to the first embodiment.
Figure 6B:
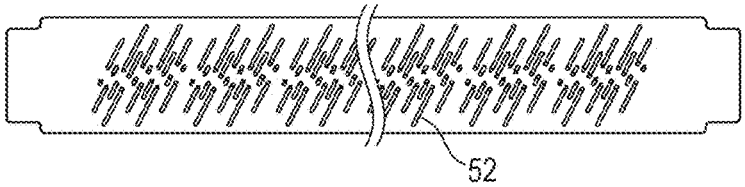
Figure 6C:
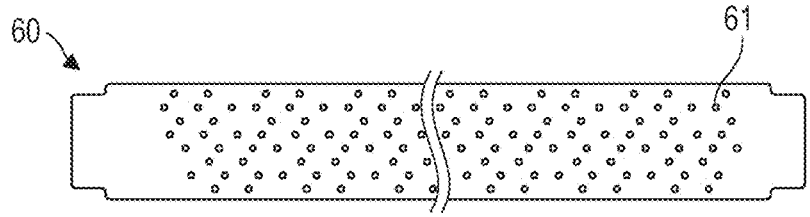
Figure 6D:
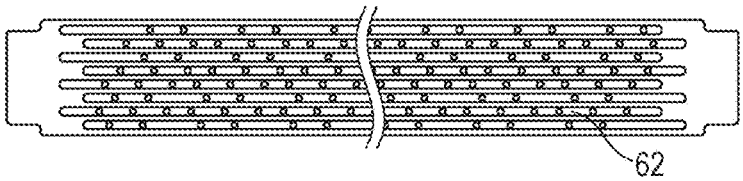
Figure 6E:
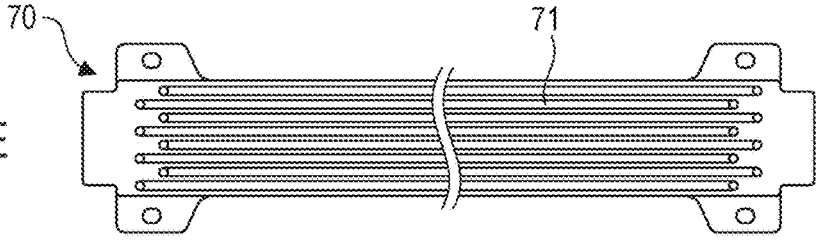
Figure 6F:
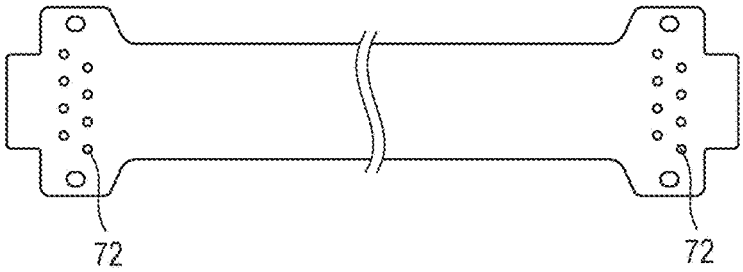
Figure 7:
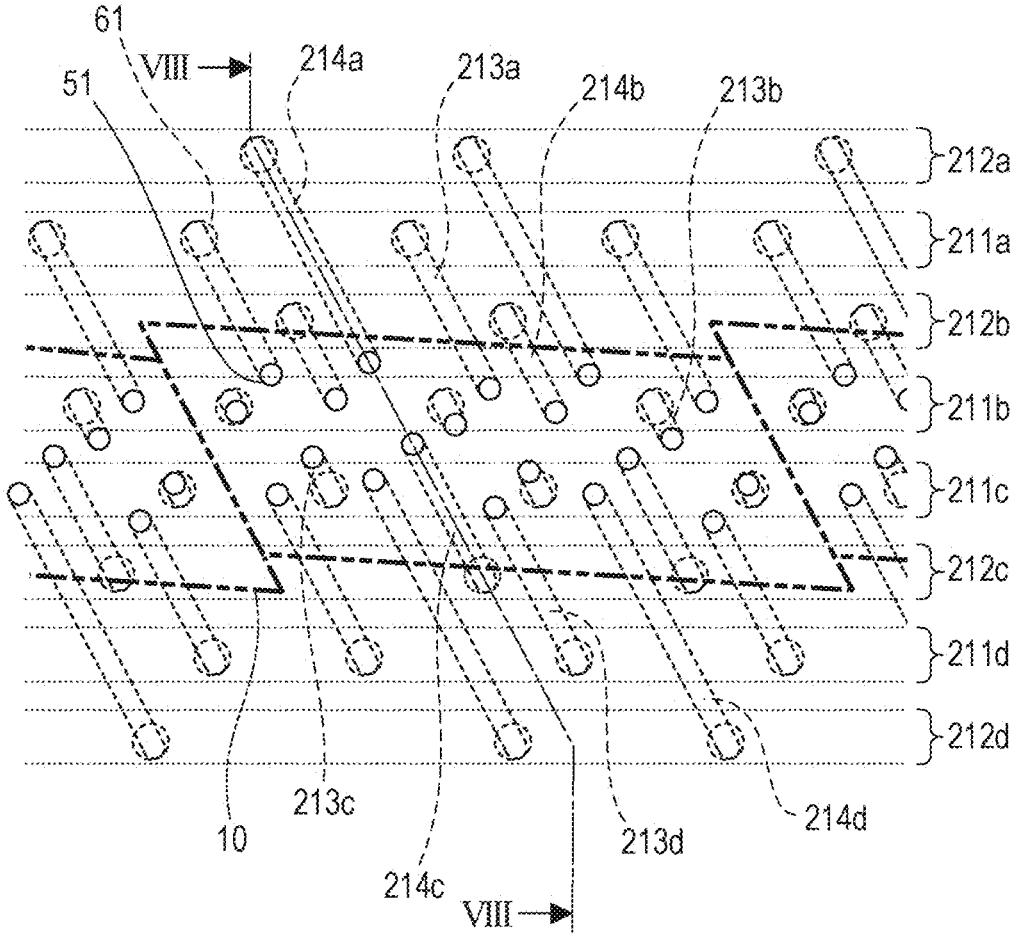
FIG. 7 is an enlarged transparent view of part of channel members in the first embodiment.

FIGS. 6A through 6F are diagrams illustrating the front and rear sides of the channel members making up the first through third channel members. FIG. 6A illustrates the side of the first channel member 50 on which the discharge modules 200 are mounted, and FIG. 6F illustrates the face of the third channel member 70 that comes in contact with the liquid discharge unit support member 81. The first channel member 50 and second channel member 60 have mutually adjoining channel member contact faces, illustrated in FIGS. 6B and 6C respectively, as do the second channel member 60 and third channel member 70 as illustrated in FIGS. 6D and 6E. The adjoining second channel member 60 and third channel member 70 have formed thereupon common channel grooves 62 and 71 which, when facing each other, form eight common channels extending in the longitudinal direction of the channel members. This forms a set of common supply channels 211 and common recovery channels 212 for each of the colors within the channel member 210 (FIG. 7). Communication ports 72 of the third channel member 70 communicate with the holes in the joint rubber members 100, so as to communicate with the liquid supply unit 220 by fluid connection. Multiple communication ports 61 are formed on the bottom face of the common channel grooves 62 of the second channel member 60, communicating with one end of individual channel grooves 52 of the first channel member 50. Communication ports 51 are formed at the other end of the individual channel grooves 52 of the first channel member 50 so as to communicate with the multiple discharge modules 200 by fluid connection via the communication ports 51. These individual channel grooves 52 allow the channels to be consolidated at the middle of the channel member.

The first through third channel members preferably are corrosion-resistant as to the liquid, and formed from a material having a low linear expansion coefficient. Examples suitable materials include alumina, liquid crystal polymer (LCP), and composite materials (resin materials) where inorganic filler such as fine particles of silica or fiber or the like has been added to a base material such as polyphenyl sulfide (PPS) or polysulfone (PSF). The channel member 210 may be formed by laminating the three channel members and adhering using an adhesive agent, or in a case of selecting a composite resin material for the material, the three channel members may be joined by fusing.

Next, the connection relationship of the channels within the channel member 210 will be described with reference to FIG. 7. FIG. 7 is a partially enlarged transparent view of channels within the channel member 210 formed by joining the first through third channel members, as viewed from the side of the first channel member 50 on which the discharge modules 200 are mounted. The channel member 210 has, for each color, common supply channels 211 (211*a*, 211*b*, 211*c*, and 211*d*) and common recovery channels 212 (212*a*, 212*b*, 212*c*, and 212*d*) extending on the longitudinal direction of the liquid discharge head 3. Multiple individual supply channels 213 (213*a*, 213*b*, 213*c*, and 213*d*) formed of the individual channel grooves 52 are connected to the common supply channels 211 of each color via the communication ports 61. Multiple individual recovery channels 214 (214*a*, 214*b*, 214*c*, and 214*d*) formed of the individual channel grooves 52 are connected to the common recovery channels 212 of each color via the communication ports 61. This channel configuration enables ink to be consolidated at the recording element boards 10 situated at the middle of the channel members, from the common supply channels 211 via the individual supply channels 213. Ink can also be recovered from the recording element boards 10 to the common recovery channels 212 via the individual recovery channels 214.

Figure 8:
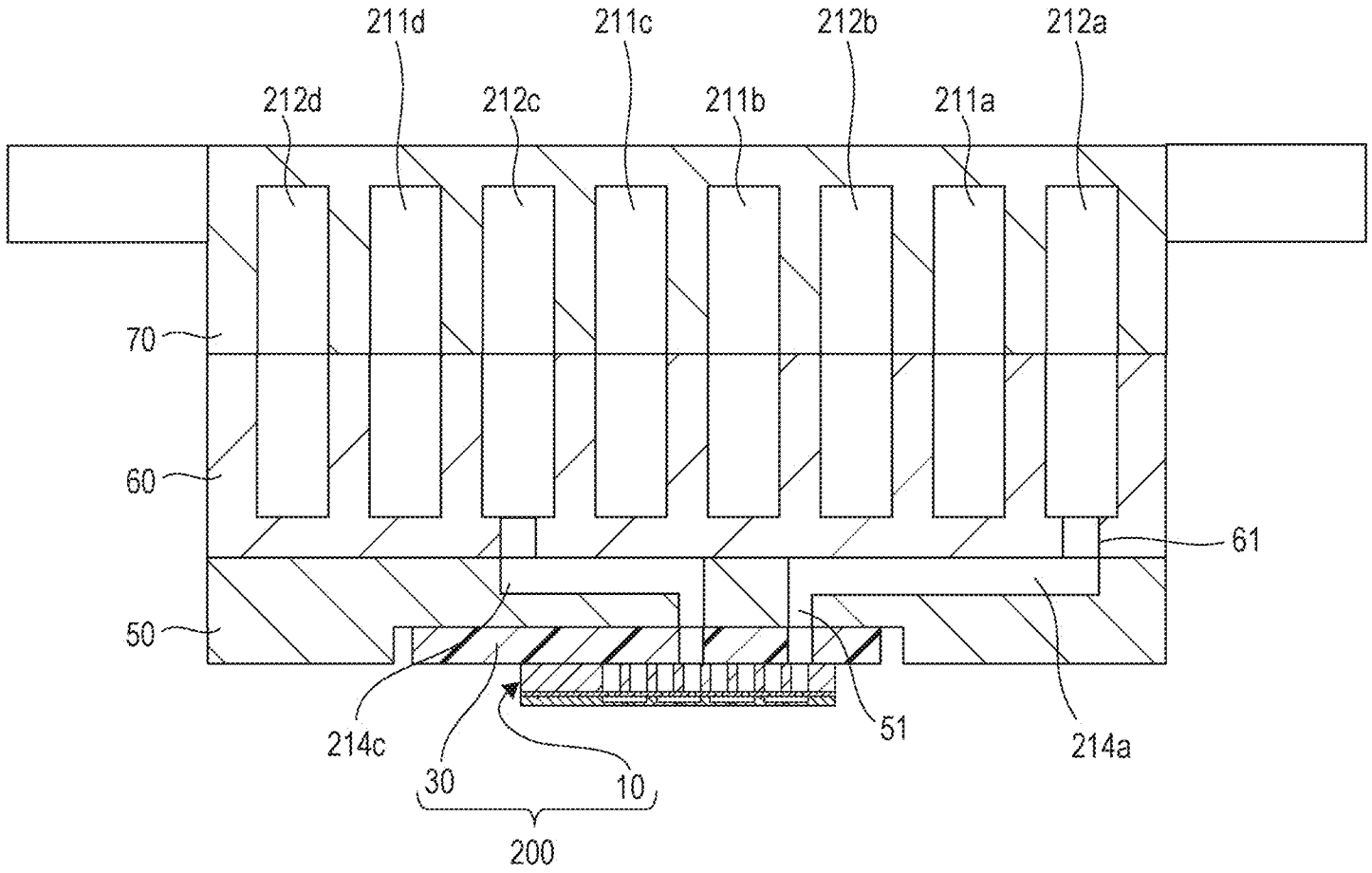
FIG. 8 is a cross-sectional view taken along line VIII-VIII in FIG. 7.

FIG. 8 is a cross-sectional view taken along line VIII-VIII in FIG. 7, illustrating that individual recovery channels (214*a* and 214*c*) communicate with the discharge module 200 via the communication ports 51. Although FIG. 8 only illustrates the individual recovery channels (214*a* and 214*c*), the individual supply channels 213 and the discharge module 200 communicate at a different cross-section, as illustrated in FIG. 7. Channels for supplying ink from the first channel member 50 to recording elements 15 (FIG. 10B), provided to the recording element board 10, are formed in a support member 30 included in the discharge module 200 and the recording element boards 10. Further, channels for recovering (recirculating) part or all of the liquid supplied to the recording elements 15 to the first channel member 50 are formed in the support member 30 and recording element boards 10. The common supply channels 211 of each color is connected to the negative pressure control unit 230 (high-pressure side) of the corresponding color via its liquid supply unit 220, and the common recovery channels 212 are connected to the negative pressure control units 230 (low-pressure side) via the liquid supply units 220. The negative pressure control units 230 generate pressure difference between the common supply channels 211 and common recovery channels 212. Accordingly, a flow occurs for each color in the liquid discharge head 3 according to the present embodiment where the channels are connected as illustrated in FIGS. 7 and 8, in the order of common supply channel 211→individual supply channels 213→recording element board 10→individual recovery channels 214→common recovery channel 212.

Description of Discharge Module

Figure 9A:
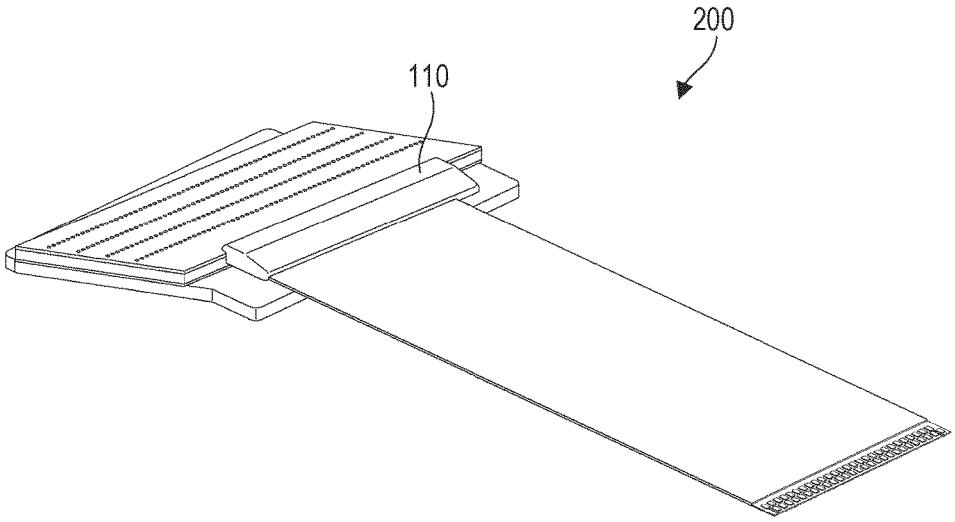
FIGS. 9A and 9B are diagrams illustrating a discharge module according to the first embodiment, FIG. 9A being a perspective view and FIG. 9B a disassembled view.
Figure 9B:
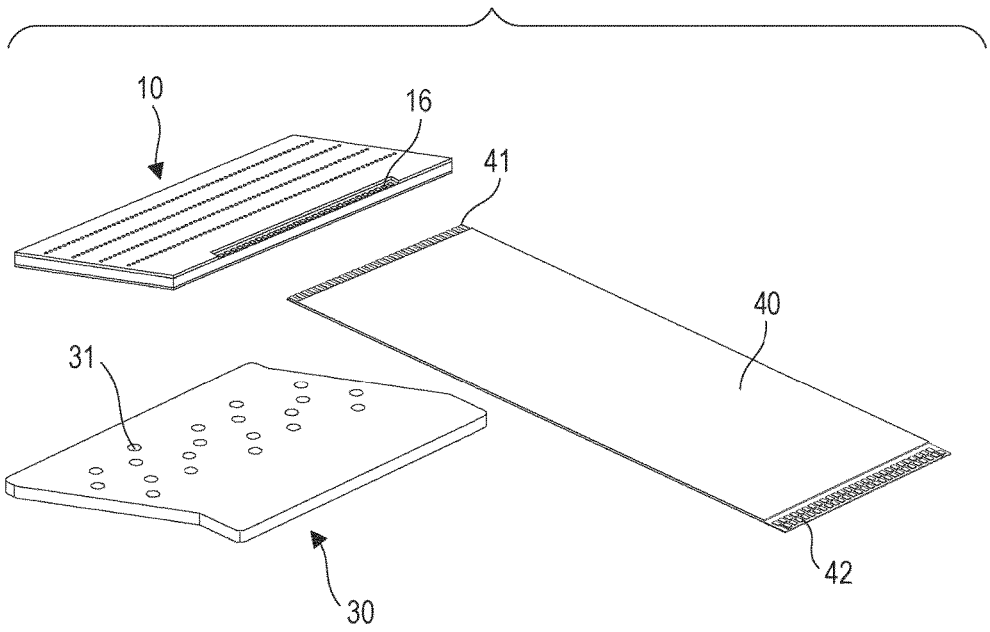

FIG. 9A illustrates a perspective view of one discharge module 200, and FIG. 9B illustrates a disassembled view thereof. The method of manufacturing the discharge module 200 is as follows. First, a recording element board 10 and flexible printed circuit board 40 are adhered to a support member 30 in which communication ports 31 have been formed beforehand. Subsequently, terminals 16 on the recording element board 10 are electrically connected to terminals 41 on the flexible printed circuit board 40 by wire bonding, following which the wire-bonded portion (electric connection portion) is covered and sealed by a sealant to form a sealing portion 110. Terminals 42 at the other end of the flexible printed circuit board 40 from the recording element board 10 are electrically connected to connection terminals 93 (FIG. 5) of the electric wiring board 90. The support member 30 is a support member that supports the recording element board 10, and also is a channel member communicating between the recording element board 10 and the channel member 210 by fluid connection. Accordingly, the support member 30 should have a high degree of flatness, and also should be able to be joined to the recording element board 10 with a high degree of reliability. Examples of suitable materials include alumina and resin materials.

Description of Structure of Recording Element Board

Figure 10A:
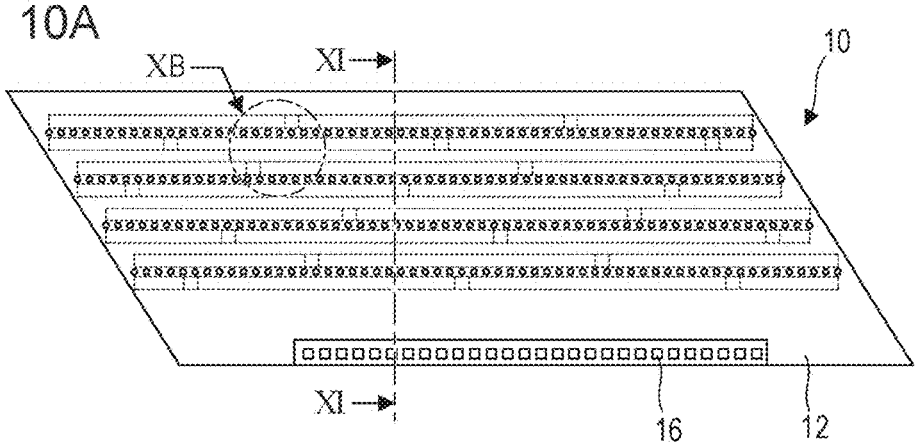
FIGS. 10A through 10C are plan views of a recording element board according to the first embodiment.
Figure 10B:
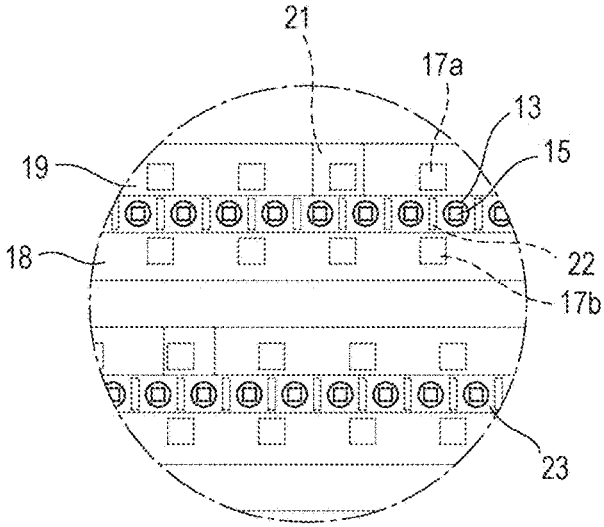
Figure 10C:
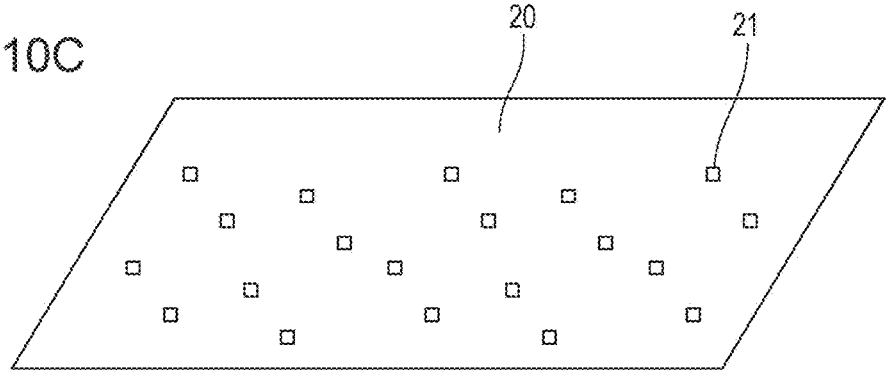

The configuration of the recording element board 10 according to the present embodiment be described. FIG. 10A is a plan view of the side of the recording element board 10 on which discharge orifices 13 have been formed. FIG. 10B is an enlarged view of the portion indicated by XB in FIG. 10A, and FIG. 10C is a plan view of the rear face of the recording element board 10 from that in FIG. 10A. The recording element board 10 has a discharge orifice forming member 12, where four discharge orifice rows corresponding to the ink colors are formed, as illustrated in FIG. 10A. Note that hereinafter, the direction in which the discharge orifice rows, where multiple discharge orifices 13 are arrayed, extend, will be referred to as "discharge orifice row" direction.

The recording elements 15, which are heating elements to cause the liquid to boil by thermal energy, are disposed at positions corresponding to the discharge orifices 13, as illustrated in FIG. 10B. Pressure chambers 23 that contain the recording elements 15 are sectioned off by partitions 22. The recording elements 15 are electrically connected to the terminals 16 in FIG. 10A by electric wiring (omitted from illustration) provided to the recording element board 10. The recording elements 15 generate heat to cause the liquid to boil, based on pulse signals input from a control circuit of the recording apparatus 1000, via the electric wiring board 90 (FIG. 5) and flexible printed circuit board 40 (FIG. 9B). The force of bubbling due to this boiling discharges the liquid from the discharge orifices 13. A liquid supply channel 18 extends along one side of each discharge orifice row, and a liquid recovery channel 19 along the other, as illustrated in FIG. 10B. The liquid supply channels 18 and liquid recovery channels 19 are channels extending in the direction of the discharge orifice rows provided on the recording element board 10, and communicate with the discharge orifices 13 via supply ports 17*a* and recovery ports 17*b*, respectively.

First and second discharge orifice rows are arrayed in parallel on the recording element board 10 as illustrated in FIG. 10B, with first and second pressure chamber rows being formed corresponding to the discharge orifices. A supply port row, recovery port row, liquid supply channel, and liquid recovery channel are provided for each of the first and second pressure chamber rows. Supply ports 17*a* and recovery ports 17*b* are provided extending in a direction intersecting the face of the substrate 11 on which the recording elements 15 are provided. Liquid supply channels and liquid recovery channels are alternately arrayed in parallel for each of the discharge orifice rows in the present embodiment. The supply port row, recovery port row, liquid supply channel, and liquid recovery channel, each extend in the direction in which the discharge orifice rows extend.

Figure 11:
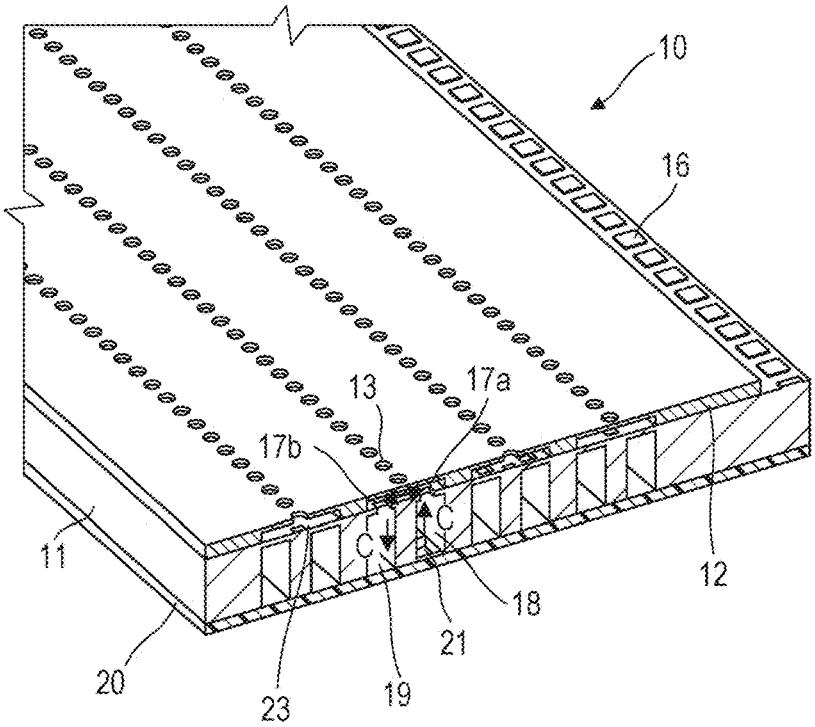
FIG. 11 is a perspective view illustrating cross-section XI-XI in FIG. 10A.

A sheet-shaped cover 20 is laminated on the rear face from, the face of the recording element board 10 on which the discharge orifices 13 are formed, the cover 20 having multiple openings 21 communicating with the liquid supply channel 18 and liquid recovery channel 19 which will be described later, as illustrated in FIGS. 10C and 11. In the present embodiment, three openings 21 are provided in the cover 20 for each Liquid supply channel 18, and two openings 21 are provided for each liquid recovery channel 19. The openings 21 of the cover 20 communicate with the multiple communication ports 51 illustrated in FIG. 6A, as illustrated in FIG. 10B. The cover 20 functions as a lid that makes up part of the sides of the liquid supply channel 18 and liquid recovery channel 19 formed in the substrate 11 of the recording element board 10, as illustrated in FIG. 11. The cover 20 preferably is sufficiently corrosion-resistant as to the liquid, and has to have a high degree of precision regarding the opening shapes of the openings 21 and the positions thereof from the perspective of color mixture prevention. Accordingly, a photosensitive resin material or silicon plate is preferably used as the material for the cover 20, with the openings 21 being formed by photolithography process. The cover 20 thus is for converting the pitch of channels by the openings 21. The cover 20 preferably is thin, taking into consideration pressure drop, and preferably is formed of a film material.

Next, the flow of liquid within the recording element board 10 will be described. FIG. 11 is a perspective view, illustrating a cross-section of the recording element board 10 and cover 20 taken along plane XI-XI in FIG. 10A. The recording element board 10 is formed by laminating the substrate 11 formed of silicon (Si) and the discharge orifice forming member 12 formed of a photosensitive resin, with the cover 20 joined on the rear face of the substrate 11. The recording elements 15 are formed on the other face side of the substrate 11 (FIG. 10B) with the grooves making up the liquid supply channels 18 and liquid recovery channels 19 extending along the discharge orifice rows being formed at the reverse side thereof. The liquid supply channels 18 and liquid recovery channels 19 formed by the substrate 11 and cover 20 are respectively connected to the common supply channels 211 and common recovery channels 212 within the channel member 210, and there is differential pressure between the liquid supply channels 18 and liquid recovery channels 19. When liquid being discharged from multiple discharge orifices 13 of the liquid discharge head 3 and recording is being performed, the liquid flows as follows due to differential pressure at the discharge orifices 13 that are not performing discharge operations. That is to say, the ink within the liquid supply channel 18 provided within the substrate 11 flows to the liquid recovery channel 19 via the supply port 17*a*, pressure chamber 23, and recovery port 17*b* (flow indicated by arrow C in FIG. 11). This flow enables ink that has thickened due to evaporation from the discharge orifices 13, bubbles, foreign substance, and so forth, to be recovered to the liquid recovery channel 19 from the discharge orifices 13 and pressure chambers 23 where recording is not being performed. This also enables thickening of ink at the discharge orifices 13 and pressure chambers 23 to be suppressed. Liquid recovered to the liquid recovery channels 19 is recovered in the order of the communication ports 51 in the channel member 210, the individual recovery channels 214, and the common recovery channel 212, via the openings 21 of the cover 20 and the liquid communication ports 31 of the support member 30 (see FIG. 9B), and is ultimately recovered to the supply path of the recording apparatus 1000.

That is to say, the liquid supplied from the recording apparatus main unit to the liquid discharge head 3 is supplied and recovered by flowing in the order described below. First, the liquid flows from the liquid connection portions 111 of the liquid supply unit 220 into the liquid discharge head 3. The liquid then is supplied to the joint rubber members 100, communication ports 72 and common channel grooves 71 provided to the third channel member 70, common channel grooves 62 and communication ports 61 provided to the second channel member 60, and individual channel grooves 52 and communication ports 51 provided to the first channel member 50. Thereafter, the liquid is supplied to the pressure chambers 23 in the order of the liquid supply channels 18 and supply ports 17*a* provided to the substrate 11. The liquid that has been supplied to the pressure chambers 23 but not discharged from the discharge orifices 13 flows in the order of the recovery ports 17*b* and liquid recovery channels 19 provided to the substrate 11, the openings 21 provided to the cover 20, and the communication ports 31 provided to the support member 30. Thereafter, the liquid flows in the order of the communication ports 51 and individual channel grooves 52 provided to the first channel member 50, the communication ports 61 and common channel grooves 62 provided to the second channel member 60, the common channel grooves 71 and communication ports 72 provided to the third channel member 70, and the joint rubber members 100. The liquid further flows outside of the liquid discharge head 3 from the liquid connection portions 111 provided to the liquid supply unit. In the first circulation path illustrated in FIG. 2, the liquid that has flowed in from the liquid connection portions 111 passes through the negative pressure control unit 230 and then is supplied to the joint rubber members 100. In the second circulation path illustrated in FIG. 3, liquid recovered from the pressure chambers 23 passes through the joint rubber members 100, and then flows out of the liquid discharge head 3 from the liquid connection portions 111 via the negative pressure control unit 230.

Also, not all liquid flowing in from one end of the common supply channel 211 of the liquid discharge unit 300 is supplied to the pressure chamber 23 via the individual supply channels 213, as illustrated in FIGS. 2 and 3. There is liquid that flows from the other end of the common supply channel 211 and through the liquid supply unit 220 without ever entering the individual supply channels 213. Thus, providing channels where liquid flows without going through the recording element board 10 enables backflow in the circulatory flow of liquid to be suppressed, even in a case where the recording element board 10 has fine channels where the flow resistance is great, as in the case of the present embodiment. Accordingly, the liquid discharge head according to the present embodiment is capable of suppressing thickening of liquid in pressure chambers and nearby the discharge orifices, thereby suppressing deviation of discharge from the normal direction and non-discharge of liquid, so high image quality recording can be performed as a result.

Description of Positional Relationship Among Recording Element Boards

Figure 12:
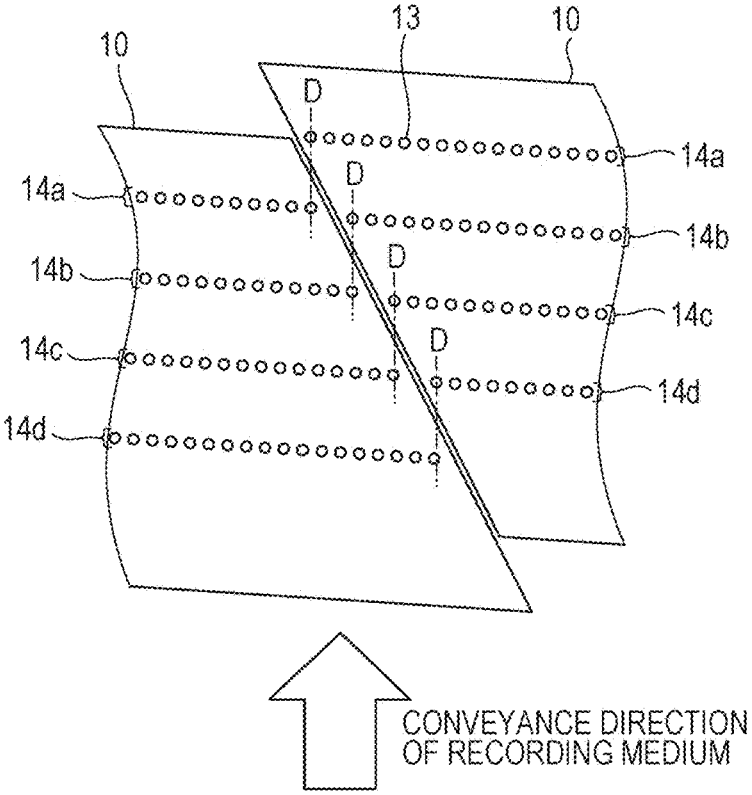
FIG. 12 is a plan view showing a partially enlarged illustration of adjacent portions of recording element boards according to the first embodiment.

FIG. 12 is a plan view illustrating a partial enlargement of adjacent portions of recording element boards 10 for two adjacent discharge modules. The recording element boards 10 according to the present embodiment are shaped as parallelograms, as illustrated in FIGS. 10A through 10C. The discharge orifice rows (14*a* through 14*d*) where discharge orifices 13 are arrayed on the recording element boards 10 are dispose inclined to the conveyance direction of the recording medium by a certain angle, as illustrated in FIG. 12. At least one discharge orifice of discharge orifice rows at adjacent portions of the recording element board 10 is made to overlap in the conveyance direction of the recording medium thereby. In FIG. 12, two discharge orifices on the lines D are in a mutually overlapping relationship. This layout enables black streaks and blank portions in the recorded image to be made less conspicuous by driving control of the overlapping discharge orifices, even in a case where the positions of the recording element board 10 are somewhat deviated from the predetermined position. The configuration illustrated in FIG. 12 can be used even in a case where the multiple recording element boards 10 are laid out in a straight line (inline) instead of in a staggered arrangement. Thus, black streaks and blank portions at overlapping portions between the recording element boards 10 can be handled while suppressing increased length of the liquid discharge head 3 in the conveyance direction of the recording medium. Although the shape of the primary face of the recording element board 10 according to the present discharge orifice row is a parallelogram, this is not restrictive. The configuration of the embodiment of the present invention can be suitably applied even in cases where the shape is a rectangle, a trapezoid, or another shape.

Second Embodiment

The configuration of an inkjet recording apparatus 1000 and liquid discharge head 3 according to a second embodiment to which the present invention is applicable will be described. Note that portions that differ from the first embodiment will primarily be described, and portions that are the same as the first embodiment will be omitted from description.

Description of Inkjet Recording Apparatus

Figure 19A:
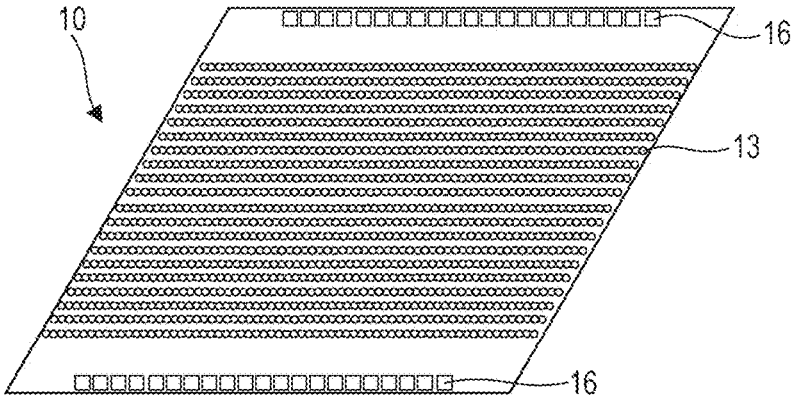
FIGS. 19A through 19B are plan views of the recording element board according to the second embodiment.
Figure 20:
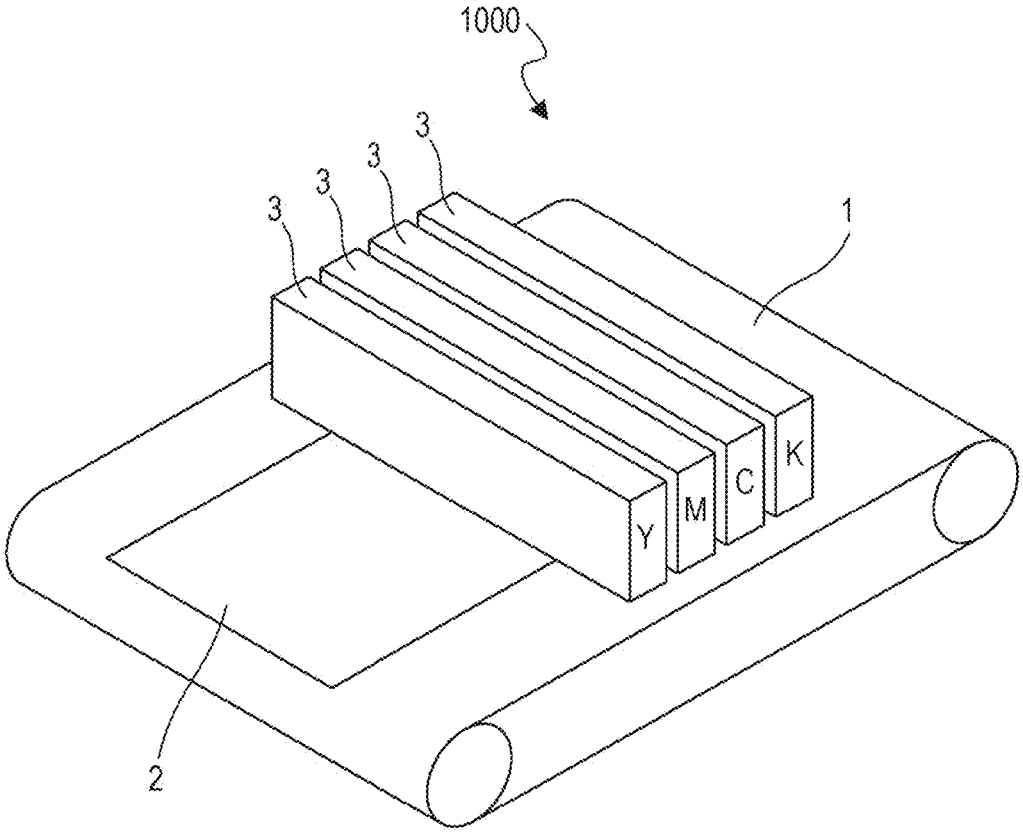
FIG. 20 is a perspective view of the inkjet recording apparatus according to the second embodiment.

FIG. 20 illustrates an inkjet recording apparatus according to the second embodiment of the present invention. The recording apparatus 1000 according to the second embodiment differs from the first embodiment with regard to the point that full-color recording is performed on the recording medium by arraying four monochrome liquid discharge heads 3, each corresponding to one of CMYK ink. Although the number of discharge orifice rows usable per color in the first embodiment was one row, the number of discharge orifice rows usable per color in the second embodiment is 20 rows (FIG. 19A). This enables extremely high-speed recording to be performed, by allocating recording data to multiple discharge orifice rows. Even if there are discharge orifices that exhibit ink non-discharge, reliability is improved by a discharge orifice at a corresponding position in the conveyance direction of the recording medium in another row performing discharge in a complementary manner, and accordingly the arrangement is suitable for industrial printing. The supply system of the recording apparatus 1000, the buffer tank 1003, and the main tank 1006 (FIG. 2) are connected to the liquid discharge heads 3 by fluid connection, in the same way as in the first embodiment. Each liquid discharge head 3 is also electrically connected to an electric control unit that transmits electric power and discharge control signals to the liquid discharge head 3.

Description of Circulation Paths

The first and second circulation paths illustrated in FIGS. 2 and 3 can be used as the liquid circulation paths between the recording apparatus 1000 and the liquid discharge heads 3, in the same way as in the first embodiment.

Description of Structure of Liquid Discharge Head

Figure 13A:
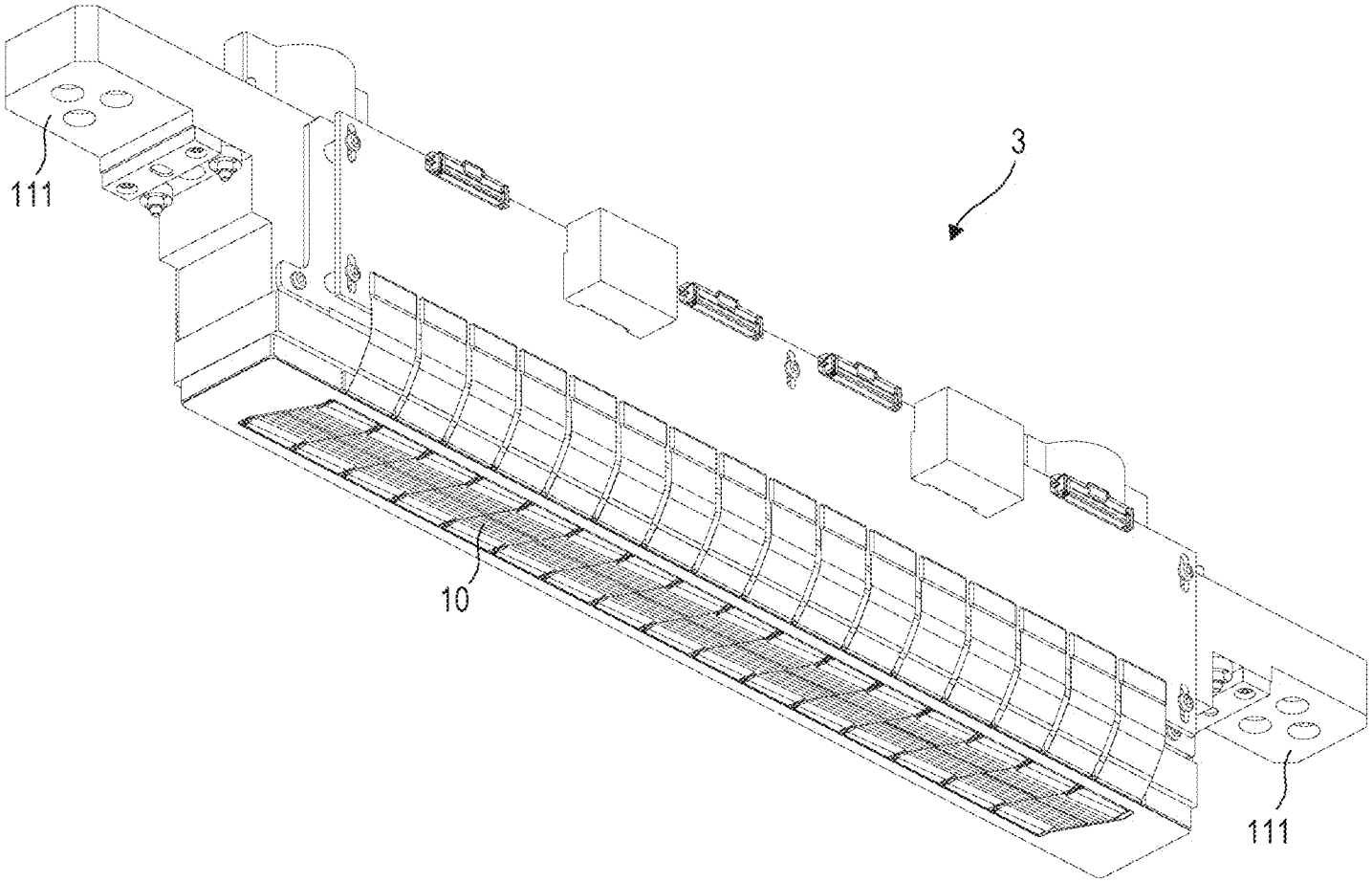
FIGS. 13A and 13B are perspective views of the liquid discharge head according to a second embodiment.
Figure 13B:
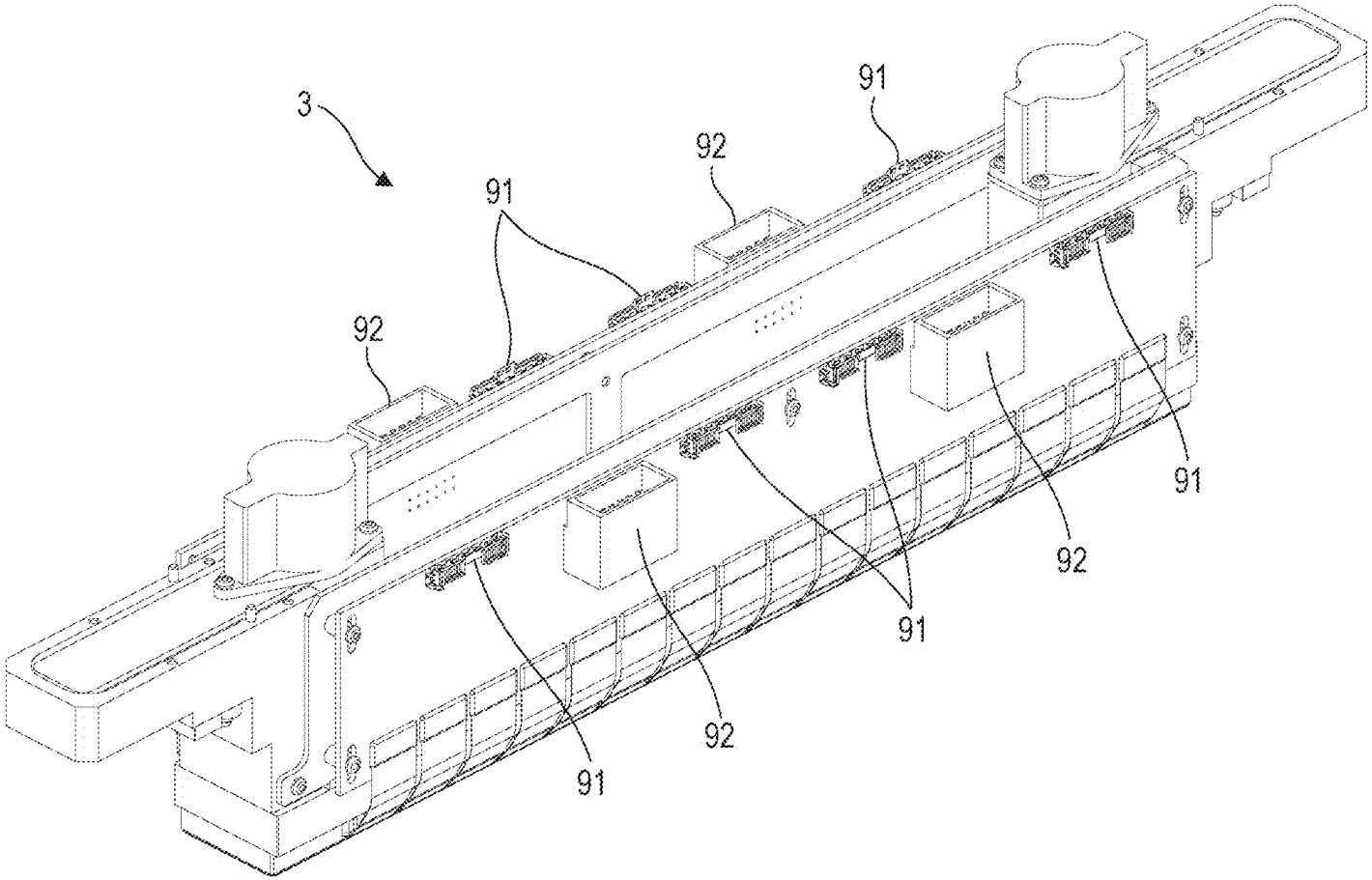

Description will be made regarding the structure of the liquid discharge head 3 according to the second embodiment of the present invention FIGS. 13A and 13B are perspective diagrams of the liquid discharge head 3 according to the present embodiment. The liquid discharge head 3 has 16 recording element hoards 10 arrayed in a straight line in the longitudinal direction of the liquid discharge head 3, and is an inkjet line recording head that can record with liquid of one color. The liquid discharge head 3 has the liquid connection portions 111, signal input terminals 91, and power supply terminals 92 in the same way as the first embodiment. The liquid discharge head 3 according to the embodiment differs from the first embodiment in that the signal input terminals 91 and power supply terminals 92 are disposed on both sides of the liquid discharge head 3, since the number of discharge orifice rows is greater. This is to reduce voltage drop and signal transmission delay that occurs at wiring portions provided to the recording element boards 10.

Figure 14:
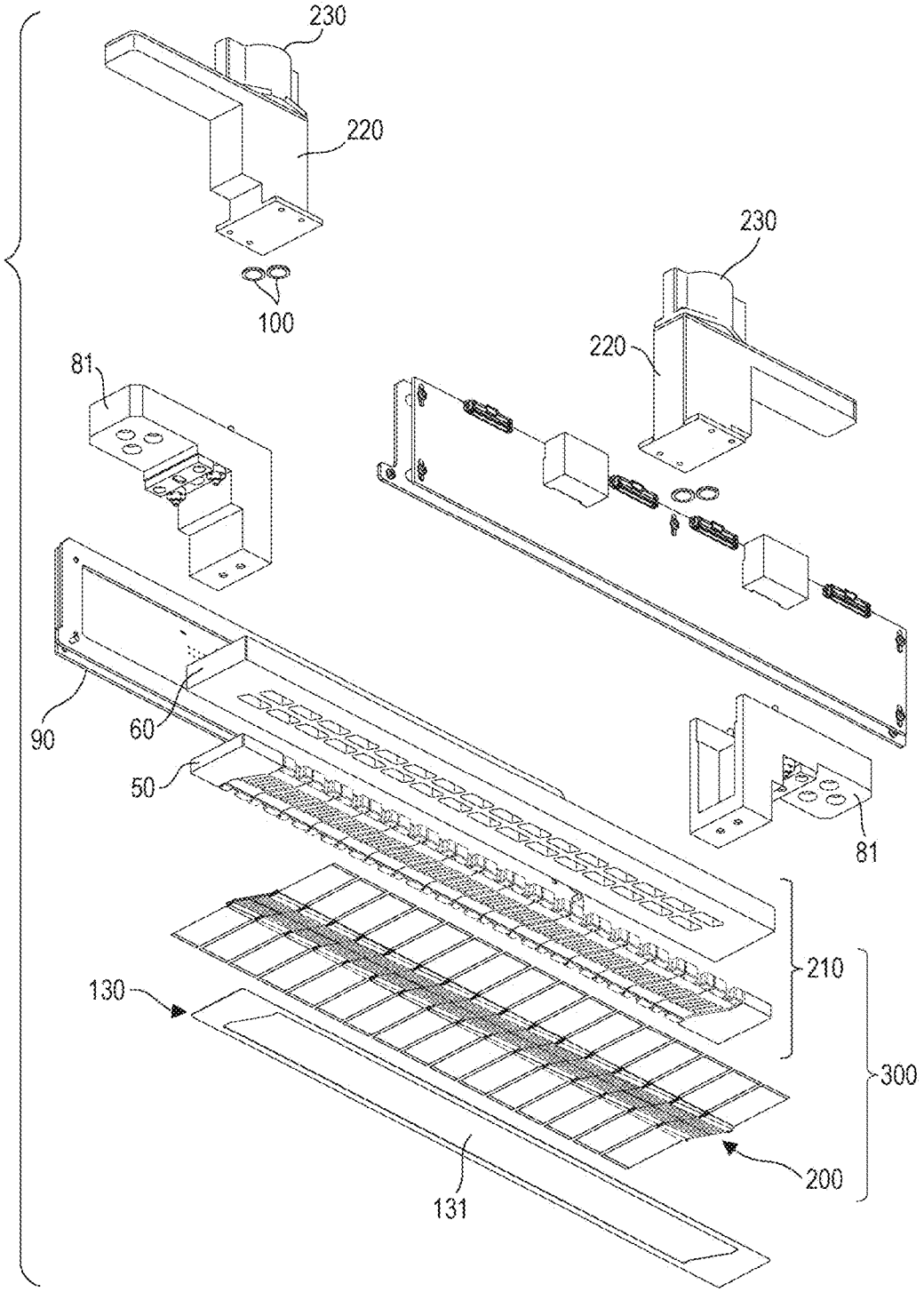
FIG. 14 is a disassembled perspective view of the liquid discharge head according to the second embodiment.

FIG. 14 is a disassembled perspective view of the liquid discharge head 3, illustrating each part or unit making up the liquid discharge head 3 disassembled according to function. The roles of the units and members, and the order of liquid flow through the liquid discharge head, are basically the same as in the first embodiment, but the function by which the rigidity of the liquid discharge head is guaranteed is different. The rigidity of the liquid discharge head was primarily guaranteed in the first embodiment by the liquid discharge unit support member 81, but the rigidity of the liquid discharge head is guaranteed in the second embodiment by the second channel member 60 included in the liquid discharge unit 300. There are liquid discharge unit support members 81 connected to both ends of the second channel member 60 in the present embodiment. This liquid discharge unit 300 is mechanically enjoined to a carriage of the recording apparatus 1000, whereby the liquid discharge head 3 is positioned. Liquid supply units 220 having negative pressure control units 230, and the electric wiring board 90, are joined to the liquid discharge unit support members 81. Filters (omitted from illustration) are built into the two liquid supply units 220. The two negative pressure control units 230 are set to control pressure by high and low negative pressure that relatively differ from each other. When the high-pressure side and low-pressure side negative pressure control units 230 are disposed on the ends of the liquid discharge head 3 as illustrated in FIG. 14, the flow of liquid on the common supply channel 211 and the common recovery channel 212 that extend in the longitudinal direction of the liquid discharge head 3 are mutually opposite. This promotes heat exchange between the common supply channel 211 and common recovery channel 212, so that the temperature difference between the two common channels can be reduced. This is advantageous in that temperature difference does not readily occur among the multiple recording element boards 10 disposed along the common channels, and accordingly unevenness in recording due to temperature difference does not readily occur.

The channel member 210 of the liquid discharge unit 300 will be described in detail next. The channel member 210 is the first channel member 50 and second channel member 60 that have been laminated as illustrated in FIG. 14, and distributes liquid supplied from the liquid supply unit 220 to the discharge modules 200. The channel member 210 also serves as a channel member for returning liquid recirculating from the discharge modules 200 to the liquid supply unit 220. The second channel member 60 of the channel member 210 is a channel member in which the common supply channel 211 and common recovery channel 212 have been formed, and also primary undertakes the rigidity of the liquid discharge head 3. Accordingly, the material of the second channel member 60 preferably is sufficiently corrosion-resistant as to the liquid and has high mechanical strength. Examples of suitably-used materials include stainless steel, titanium (Ti), alumina, or the like.

Figure 15A:
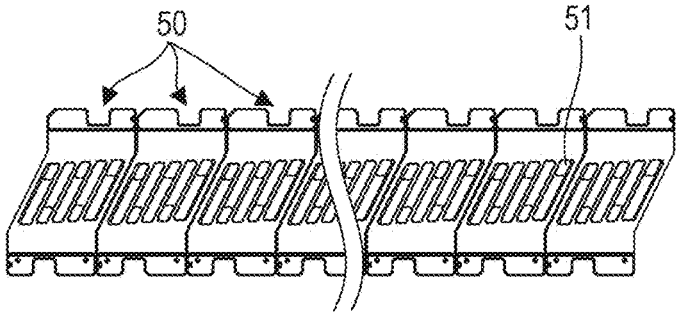
FIGS. 15A through 15E are plan views of first and second channel members making up the channel member according to the second embodiment.
Figure 15B:
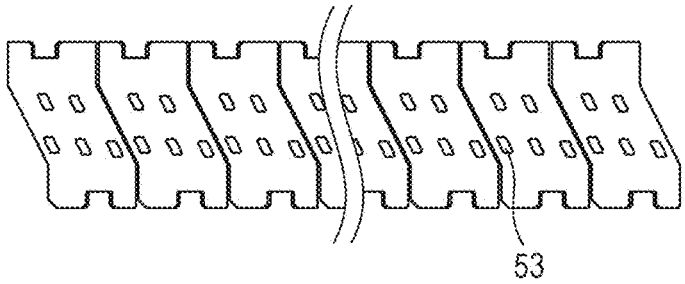
Figure 15C:
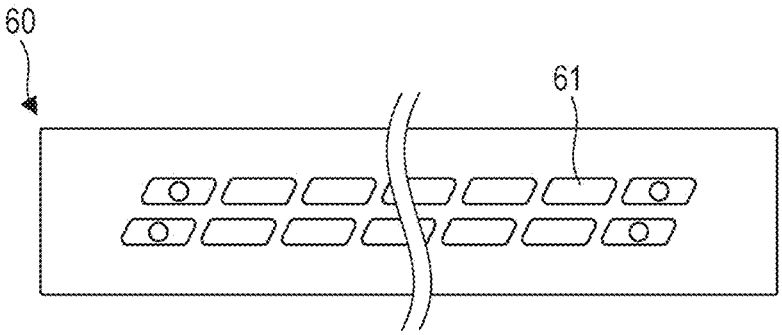
Figure 15D:
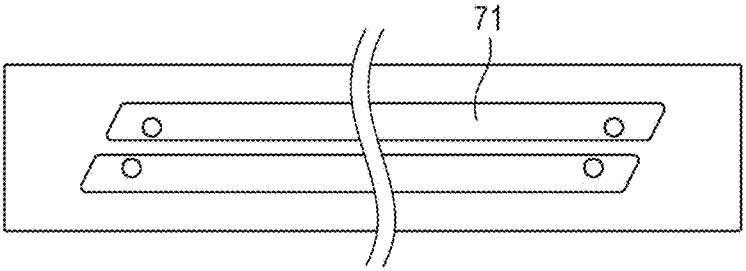
Figure 15E:
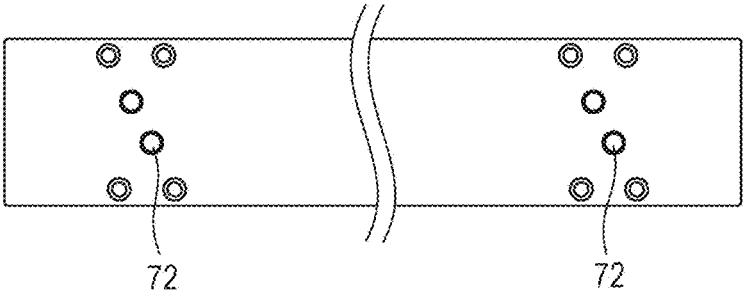

FIG. 15A illustrates the face of the first channel member 50 on the side where the discharge modules 200 are mounted, and FIG. 15B is a diagram illustrating the reverse face therefrom, that comes into contact with the second channel member 60. Unlike the case in the first embodiment, the first channel member 50 according to the second embodiment is an arrangement where multiple members corresponding to the discharge modules 200 are arrayed adjacently. Using this divided structure enables a length corresponding to the length of the liquid discharge head to be realized, and accordingly can particularly be suitably used in relatively long-scale liquid discharge heads corresponding to sheets of B2 size and even larger, for example. The communication ports 51 of the first channel member 50 communicate with the discharge modules 200 by fluid connection as illustrated in FIG. 15A, and individual communication ports 53 of the first channel member 50 communicate with the communication ports 61 of the second channel member 60 by fluid connection, as illustrated in FIG. 15B. FIG. 15C illustrates the face of the second channel member 60 that comes in contact with the first channel member 50. FIG. 15D illustrates a cross-section of the middle portion of the second channel member 60 taken in the thickness direction, and FIG. 15E is a diagram illustrating the face of the second channel member 60 that comes into contact with the liquid supply unit 220. The functions of the channels and communication ports of the second channel member 60 are the same as with one color worth in the first embodiment. One of the common channel grooves 71 of the second channel member 60 is the common supply channel 211 illustrated in FIG. 16, and the other is the common recovery channel 212. Both have liquid supplied from one end side toward the other end side following the longitudinal direction of the liquid discharge head 3. Unlike the case in the first embodiment, the longitudinal directions of liquid for the common supply channel 211 and common recovery channel 212 are mutually opposite directions.

Figure 16:
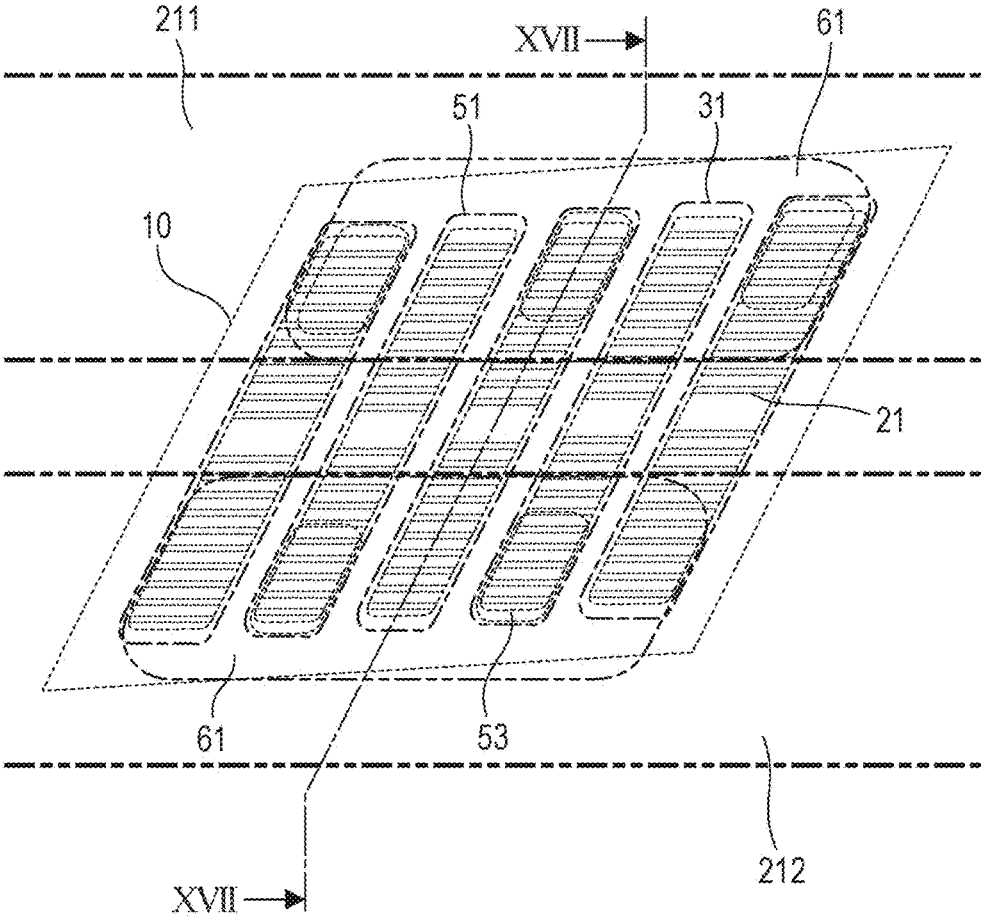
FIG. 16 is an enlarged transparent view of part of the channel member according to the second embodiment.

FIG. 16 is a transparent view illustrating the connection relationship regarding liquid between the recording element boards 10 and the channel member 210. The set of the common supply channel 211 and common recovery channel 212 extending in the longitudinal direction of the liquid discharge head 3 is provided within the channel member 210, as illustrated in FIG. 16. The communication ports 61 of the second channel member 60 are each positioned with and connected to the individual communication ports 53 of the first channel member 50, thereby forming a liquid supply path from the communication ports 72 of the second channel member 60 to the communication ports 51 of the first channel member 50 via the common supply channel 211. In the same way, a liquid supply path from the communication ports 72 of the second channel member 60 to the communication ports 51 of the first channel member 50 via the common recovery channel 212 is also formed.

Figure 17:
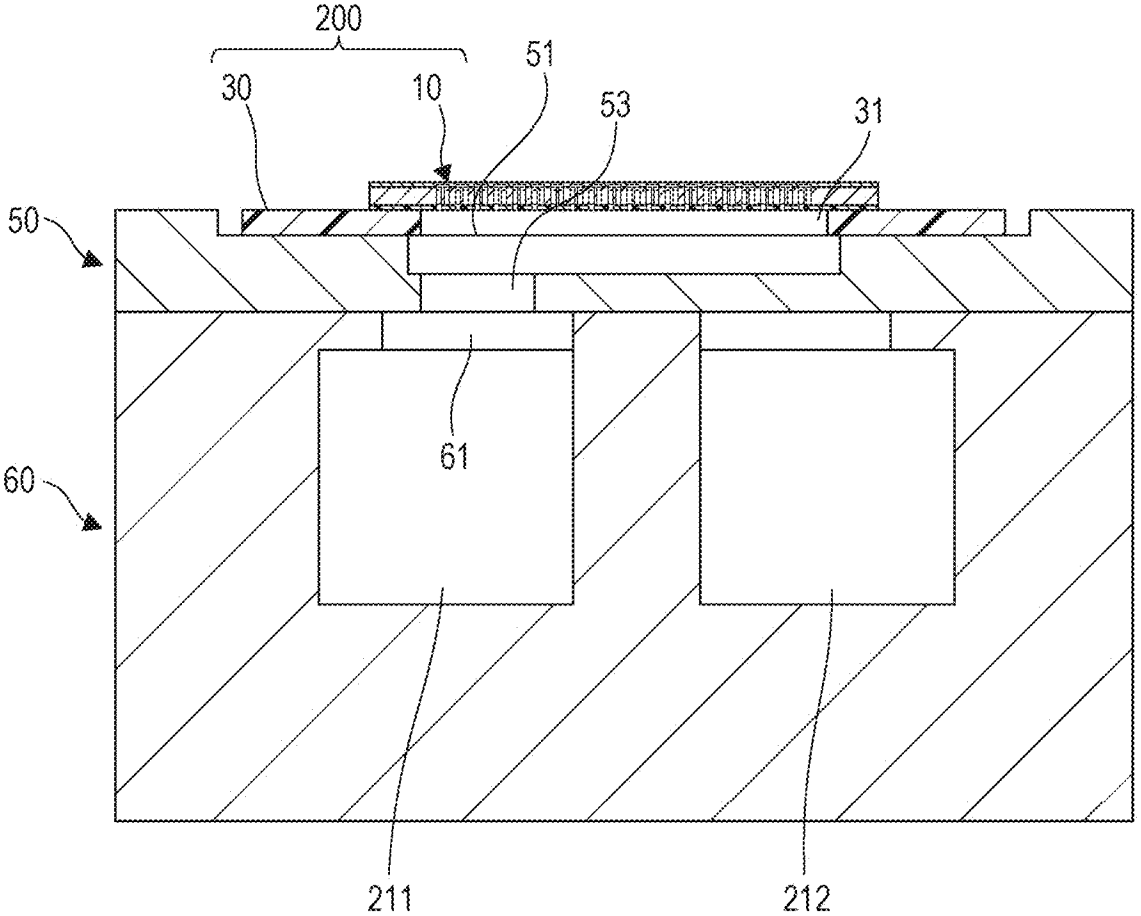
FIG. 17 is a cross-sectional view taken along line XVII-XVII in FIG. 16.

FIG. 17 is a diagram illustrating a cross-section taken along XVII-XVII in FIG. 16. FIG. 17 shows how the common supply channel 211 connects to the discharge module 200 through the communication port 61, individual communication port 53, and communication port 51. Although omitted from illustration in FIG. 17, can be clearly seen from FIG. 16 that another cross-section would show an individual recovery channel 214 connected to the discharge module 200 through a similar path. Channels are formed on the discharge modules 200 and recording element boards 10 to communicate with the discharge orifices 13, and part or all of the supplied liquid recirculates through the discharge orifices 13 (pressure chambers 23) that are not performing discharging operations, in the same way as in the first embodiment. The common supply channel 211 is connected to the negative pressure control unit 230 (high-pressure side), and the common recovery channel 212 to the negative pressure control unit 230 (low-pressure side), via the liquid supply unit 220, in the same way as in the first embodiment. Accordingly, a flow is generated by the differential pressure thereof, that flows from the common supply channel 211 through the discharge orifices 13 (pressure chambers 23) of the recording element board 10 to the common recovery channel 212.

Description of Discharge Module

Figure 18A:
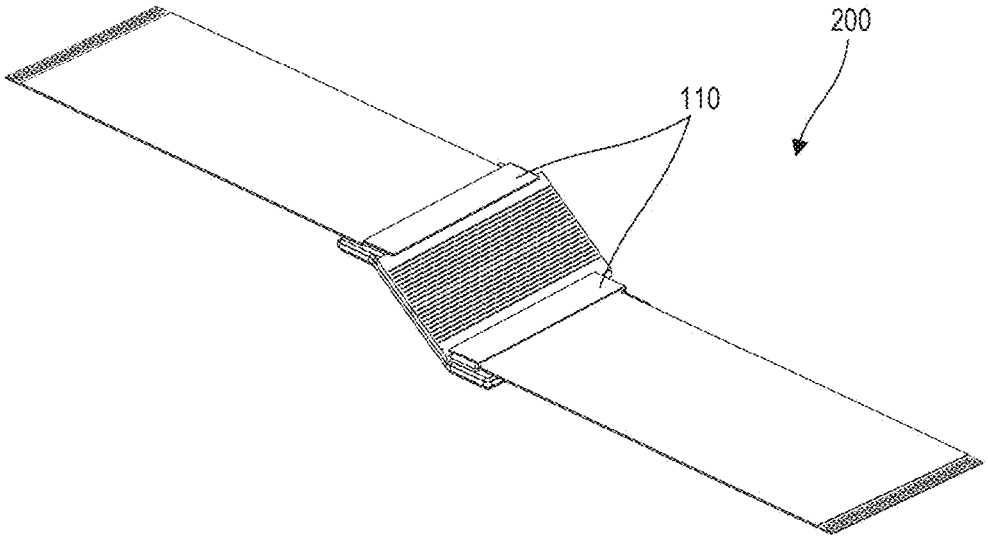
FIGS. 18A and 18B are diagrams illustrating a discharge module according to the second embodiment, FIG. 18A being a perspective view and FIG. 18B a disassembled view.
Figure 18B:
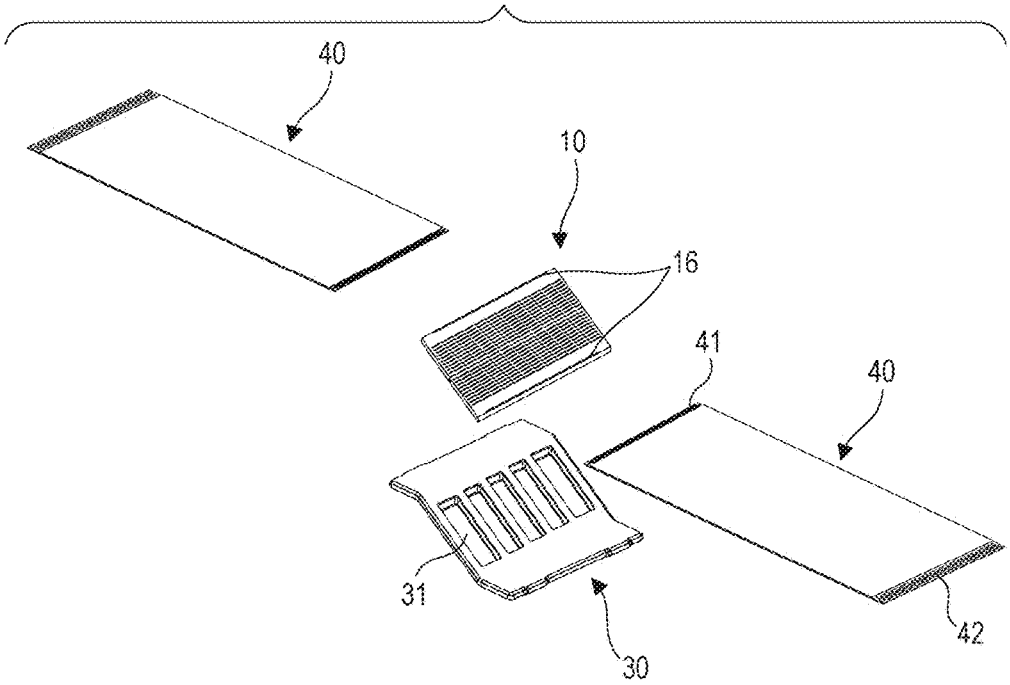

FIG. 18A is a perspective view of one discharge module 200, and FIG. 18B is a disassembled view thereof. The difference as to the first embodiment is the following point, that is to say that multiple terminals 16 are disposed arrayed on both sides (the long side portions of the recording element board 10) following the direction of the multiple discharge orifice rows of the recording element board 10, and that two flexible printed circuit boards 40 are provided to one recording element board 10 and are electrically connected thereto. The reason is that the number of discharge orifice rows provided on the recording element board 10 is 20 rows, which is a great increase over the eight rows in the first embodiment. The object thereof is to keep the maximum distance from the terminals 16 to the recording elements 15 provided corresponding to the discharge orifice row short, hereby reducing voltage drop and signal transmission delay that occurs at wiring portions provided to the recording element board 10. Liquid communication ports 31 of the support member 30 are provided to the recording element board 10, and are opened so as to span all discharge orifice rows. Other points are the same as in the first embodiment.

Description of Structure of Recording Element Board

Figure 19B:
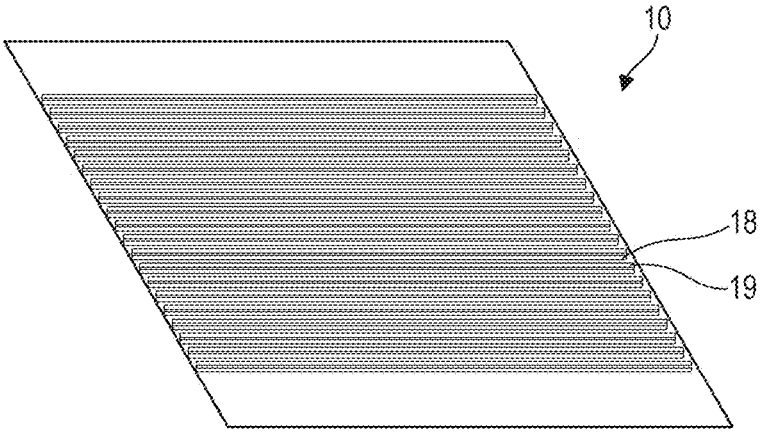
Figure 19C:
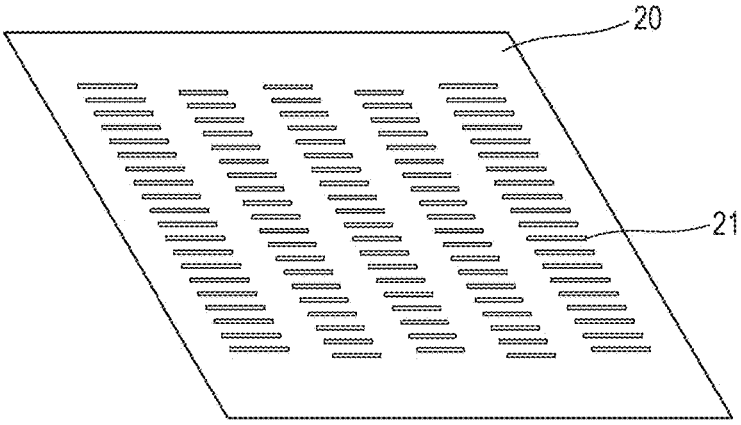

FIG. 19A is a schematic diagram illustrating the face of the recording element board 10 on the side where the discharge orifices 13 are disposed, and FIG. 19C is a schematic diagram illustrating the reverse face of that illustrated in FIG. 19A. FIG. 19B is a schematic diagram illustrating the face of the recording element board 10 in a case where the cover 20 provided on the rear face side of the recording element board 10 is removed in FIG. 19C. Liquid supply channels 10 and liquid recovery channels 19 are alternately provided on the rear face of the recording element board 10 following the discharge orifice row direction, as illustrated in FIG. 19B. Despite the number of discharge orifice rows being much greater than that in the first embodiment, a substantial difference from the first embodiment is that the terminals 16 are disposed on both side portions of the recording element board 10 following the discharge orifice row direction, as described above. The basic configuration is the same as that in the first embodiment, such as one set of a liquid supply channel 18 and liquid recovery channel 19 being provided for each discharge orifice row, openings 21 that communicate with the liquid communication ports 31 of the support member 30 being provided to the cover 20, and so forth.

Description of Features Common to the Embodiments

Next, configurations that are features common to the above-described embodiments will be described. Although the following description relates to the liquid discharge head according to the first embodiment, illustrated in FIGS. 1 through 12, application can be made to the liquid discharge head according to the second embodiment in the same way.

Description of Flow of Liquid within Discharge Orifice

Figure 21A:
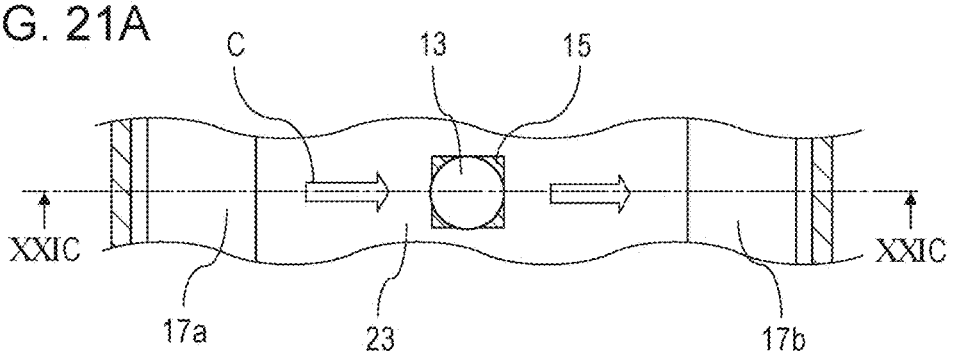
FIGS. 21A through 21C are diagrams illustrating primary portions of a liquid discharge head, FIG. 21A being a plan view, 21B a cross-sectional view, and FIG. 21C a perspective view.
Figure 21B:
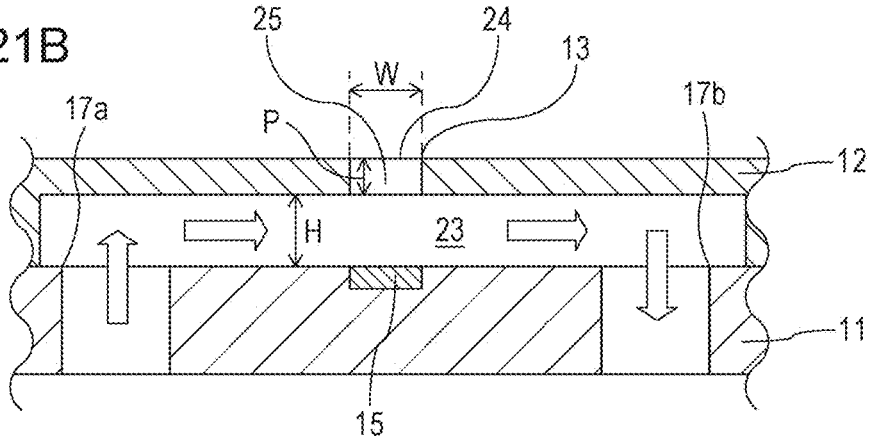
Figure 21C:
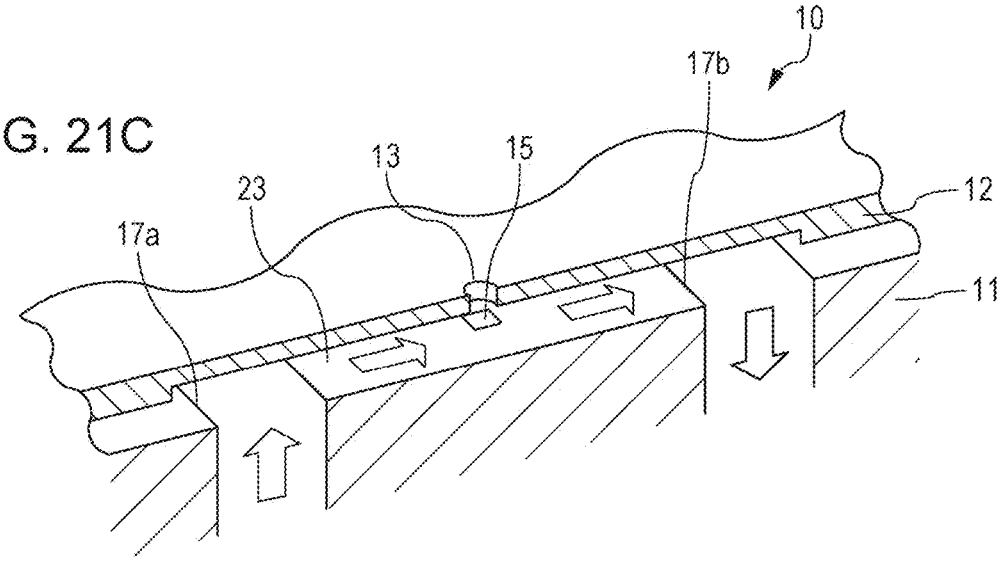

FIGS. 21A through 21C are schematic diagrams for describing near a discharge orifice of a recording element board in detail. FIG. 21A is a plan view from the discharge direction in which liquid is discharged. FIG. 21B is a cross-sectional view taken along line XXIB-XXIB in FIG. 21A, and FIG. 21C is a perspective view illustrating the cross-section taken along line XXIC-XXIC in FIG. 21A.

A circulatory flow C, where liquid within the liquid supply channel 18 provided to the substrate 11 flows to the liquid recovery channel 19 via the supply port 17*a*, pressure chamber 23, and recovery port 17*b*, is formed in the recording element board 10 with regard to discharge orifices 13 that are not performing discharge operations as described above. The speed of the circulatory flow C in the pressure chamber 23 is around 0.1 to 100 mm/s for example, and is a speed where performing discharging operations in a state where the liquid is flowing has little effect on droplet landing accuracy and so forth. A liquid meniscus, i.e., a discharge orifice interface 24 that is an interface between the liquid and the atmosphere, is formed at the discharge orifice 13. The discharge orifice 13 is an opening situated at the end of a cylinder discharge orifice portion 25, the discharge orifice portion 25 communicating with the discharge orifice 13 and pressure chamber 23, as illustrated in FIG. 21B. In the following description, the through path 25 will be referred to as "discharge orifice portion", the direction in which liquid is discharged from the discharge orifice 13 (vertical direction in FIG. 21B) will be referred to as "discharge direction", and the direction in which the liquid flows in the pressure chamber 23 (horizontal direction in FIG. 21B) will be referred to simply as "flow direction".

Now, the dimensions of the pressure chamber 23 and discharge orifice portion 25 will be defined as follows. The height of the pressure chamber 23 at the upstream side thereof from the portion communicating with the discharge orifice portion 25 is defined as H, the length of the discharge orifice portion 25 in the discharge direction is defined as P, and the width in the flow direction is defined as W. An example of these dimensions is 3 through 30 μm for H, 3 through 30 μm for P, and 6 through 30 μm for W. Also, an example will be described below of a case where the discharged liquid is ink that has been adjusted to nonvolatile solvent concentration of 30%, color material concentration of 3%, and viscosity of 0.002 to 0.003 Pa·s.

Figure 22:
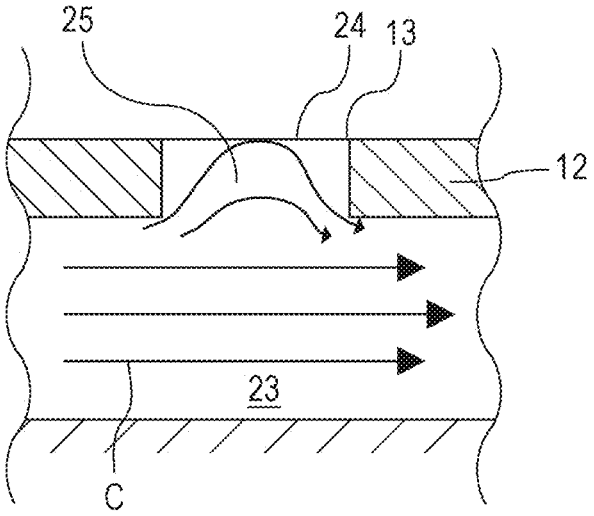
FIG. 22 is an enlarged cross-sectional view of near a discharge orifice of the liquid discharge head.

FIG. 22 is an enlarged cross-sectional view of near the discharge orifice 13, and represents the state of the circulatory flow C at the discharge orifice 13, discharge orifice portion 25, and pressure chamber 23, when the circulatory flow C is in a steady state. Specifically, the arrows indicate the flow of ink that has flowed into the pressure chamber 23 from the supply port 17*a* at a flow rate of $1.26\times10^{-4}$ ml/min, in a recording element board 10 where the above-described H is 14 μm, P is 5 μm, and W is 12.4 μm. Note that, the lengths of the arrows in FIG. 22 do not represent speed.

Although evaporation of ink from the discharge orifices 13 causes change in the color material concentration, the recording element board 10 of the dimensions described above is arranged to suppress such ink from stagnating at the discharge orifice 13 and discharge orifice portion 25. That is to say, part of the circulatory flow C in the pressure chamber 23 flows inside the discharge orifice portion 25, reaches the position of the meniscus formed in the discharge orifices 13 (nearby the meniscus interface), and then returns from the discharge orifice portion 25 to the pressure chamber 23. Accordingly, not only ink at the discharge orifice portion 25 that is readily affected by evaporation, but also ink near the discharge orifice interface 24 where the effects of evaporation are particularly great, can be made to flow to the pressure chamber 23 without standing inside the discharge orifice portion 25. A feature of the circulatory flow C here is that it has, regarding the flow direction (from the left to the right in FIG. 21B) nearby at least the middle portion of the discharge orifice interface 24 (center portion of the discharge orifice), a speed component (hereinafter referred to as "positive speed component"). A flow mode where the circulatory flow C has the positive speed component at least near the middle portion of the discharge orifice interface 24, such as illustrated in FIG. 22, will be referred to as "flow mode A". A flow mode where the circulatory flow C has a negative speed component (from the right to the left in FIG. 21B) opposite to the positive speed component near the middle portion of the discharge orifice interface 24, which will be described later, will be referred to as "flow mode B".

The present inventors have found that whether the circulatory flow C in the liquid discharge head is flow mode A (or flow mode B) is determined by the dimensions H, P, and W of the pressure chamber 23 and discharge orifice portion 25 described above. That is to say, in a liquid discharge head where the circulatory flow C is flow mode A, the height H of the pressure chamber 23 at the upstream side thereof, the Length P of the discharge orifice portion 25 in the discharge direction, and the length W in the flow direction, satisfy the following relationship (see FIG. 21B).

$$H^{-0.34}\times P^{-0.66}\times W>1.7 \tag{1}$$

Accordingly, the flow mode A such as illustrated in FIG. 22 is realized in a liquid discharge head that satisfies the relationship in Expression (1), while the flow mode B is realized in a liquid discharge head that does not satisfy the relationship in Expression (1). The left side of Expression (1) will be referred to as "determination value j".

Figure 23:
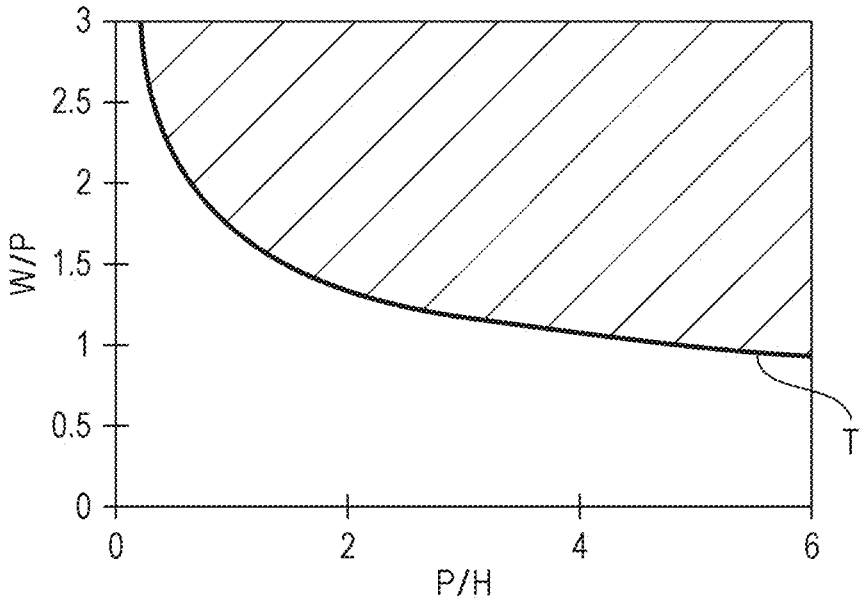
FIG. 23 is a graph for describing the relationship between head dimensions and flow mode.

FIG. 23 is a graph for explaining the relationship between the dimensions of the liquid discharge head and the flow mode. The horizontal axis represents the ratio of P to H (P/H), and the vertical axis represents the ratio of W to P (W/P). The heavy line T in FIG. 23 is a threshold line that satisfies the following relationship.

$$\left(\frac{W}{P}\right)=1.7\times\left(\frac{P}{H}\right)^{-0.34} \tag{2}$$

The flow mode A is realized at the liquid discharge head at the portion where the relationship of H, P, and W is above the threshold line T (the hatched region) in FIG. 23, and the flow mode B is realized below the threshold line T. That is to say, the flow mode A is realized in a liquid discharge head satisfying the following relationship.

$$\left(\frac{W}{P}\right)>1.7\times\left(\frac{P}{H}\right)^{-0.34} \tag{3}$$

Reordering Expression (3) yields Expression (1), so the flow mode A is realized in a liquid discharge head where the relationship of H, P, and W satisfies Expression (1) (a liquid discharge head where the determination value J is 1.7 or greater). On the other hand, the flow mode B is realized in a liquid discharge head where the relationship of H, P, and W satisfies the following relationship.

$$H^{-0.34}\times P^{-0.66}\times W\leq1.7 \tag{4}$$

Now, a liquid discharge head with the flow mode B is advantageous with regard to the point that cracking of the discharge orifice forming member 12 can be suppressed, since the length P in the discharge direction of the discharge orifice portion 25, i.e., the thickness of the discharge orifice forming member 12, can be made larger. The height H of the pressure chamber 23 also can be made higher, which also is advantageous since the pressure difference necessary for generating the circulatory flow C can be smaller.

Figure 24:
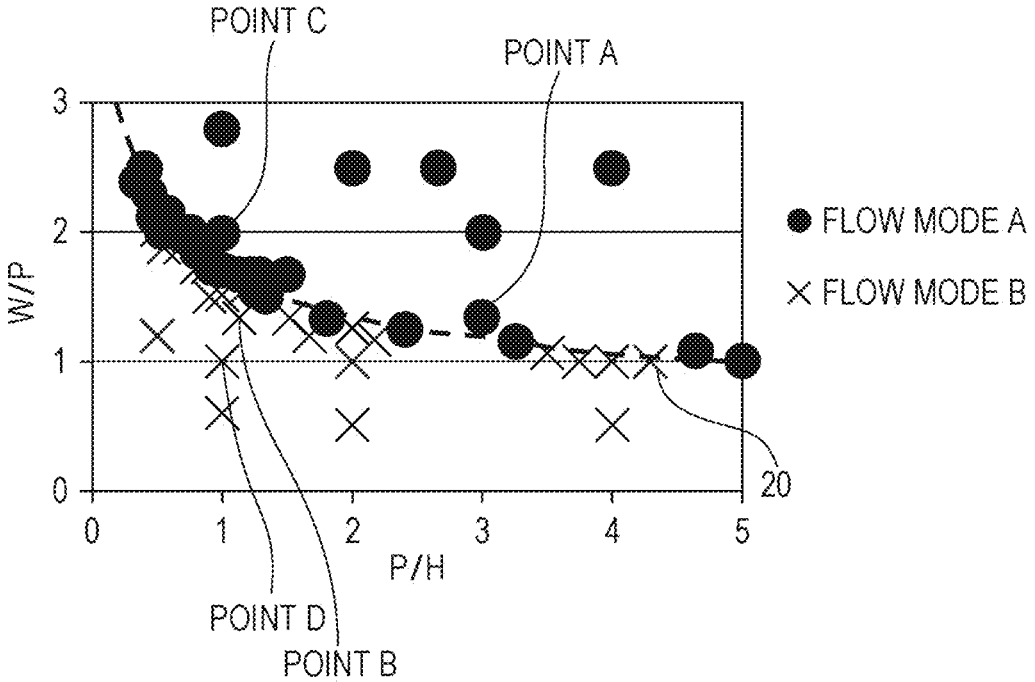
FIG. 24 is a graph illustrating the results of having confirmed the relationship between head dimensions and flow mode.
Figure 25A:
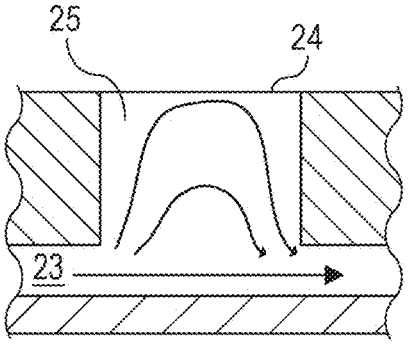
FIGS. 25A through 25D are diagrams illustrating circulatory flows within a discharge channel.
Figure 25B:
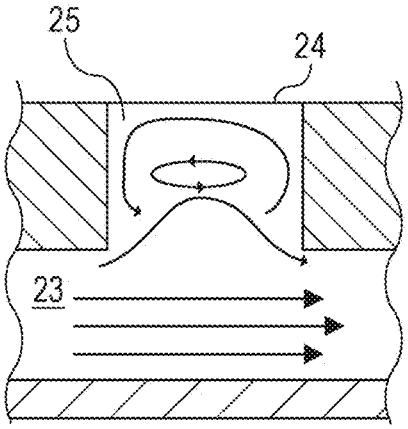
Figure 25C:
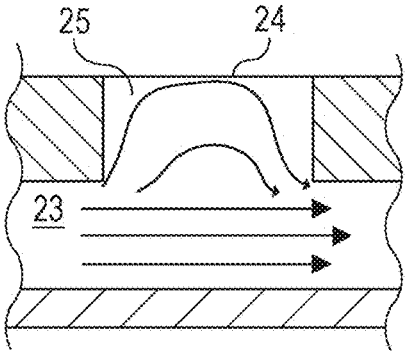
Figure 25D:
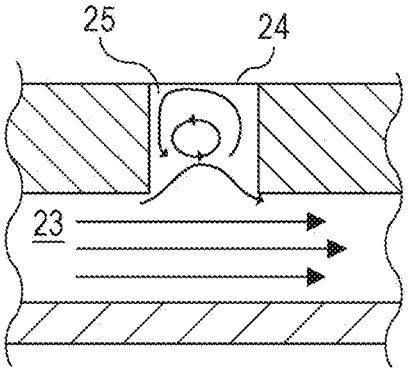

The above relational expressions and the flow within the discharge orifice portion 25 will be described in detail, with reference to FIGS. 24 through 25D. FIG. 24 is a graph illustrating the results of having confirmed the flow within the discharge orifice portion of liquid discharge heads of various shapes. The dots in FIG. 24 represent liquid discharge heads determined to have flow mode A, and the crosses represent liquid discharge heads determined to have flow mode B. FIGS. 25A through 25D are diagrams illustrating examples of circulatory flows in liquid discharge heads indicated by respective points A through D in FIG. 24.

The liquid discharge head indicated by point A in FIG. 24 has H of 3 μm, P of 9 μm, and W of 12 μm. The determination value J that is the left side of Expression (1) is 1.93, which is larger than 1.7. In this case, the actual flow within the discharge orifice portion 25 is such as illustrated in FIG. 25A, which is a flow mode A having a positive speed component near the middle portion of the discharge orifice interface 24. The liquid discharge head indicated by point B in FIG. 24 has H of 8 μm, P of 9 μm, and W of 12 μm. The determination value J is 1.39, which is smaller than 1.7. In this case, the actual flow within the discharge orifice portion 25 is such as illustrated in FIG. 25B, which is a flow mode B having a negative speed component near the middle portion of the discharge orifice interface 24. The liquid discharge head corresponding to point C in FIG. 24 has H of 6 μm, P of 6 μm, and W of 12 μm. The determination value J is 2.0, which is larger than 1.7. In this case, the actual flow within the discharge orifice portion 25 is such as illustrated in FIG. 25C, which is a flow mode A having a positive speed component near the middle portion of the discharge orifice interface 24. The liquid discharge head indicated by point D in FIG. 24 has H of 6 μm, P of 6 μm, and W of 6 μm. The determination value J is 1.0, which is smaller than 1.7. In this case, the actual flow within the discharge orifice portion 25 is such as illustrated in FIG. 25D, which is a flow mode B having a negative speed component near the middle portion of the discharge orifice interface 24.

Thus, liquid discharge heads that exhibit flow mode A and liquid discharge heads that exhibit flow mode B can be distinguished by the threshold line T in FIG. 23 as a boundary. That is to say, liquid discharge heads where the determination value J in Expression (1) is larger than 1.7 realize the flow mode A, and the circulatory flow C has a positive component at least at near the middle portion of the discharge orifice interface 24.

Note that the conditions of H, P, and W are dominating influences on whether the circulatory flow C within the discharge orifice portion 25 is flow mode A or flow mode B. Influence of other conditions, such as the flow velocity of the circulatory flow C, the viscosity of ink, the width of the discharge orifice 13 (length in the direction orthogonal to the direction of the flow), for example, is minute in comparison with the conditions of H, P, and W. Accordingly, the flow velocity of the circulatory flow C and the ink viscosity can be set as suitable, in accordance with required specifications of the liquid discharge head (inkjet recording apparatus) and usage environment conditions. For example, a flow velocity of the circulatory flow C in the pressure chamber 23 of 0.1 to 100 mm/s, and ink having viscosity of 0.01 Pa·s or less, can be used. In a case where the amount of ink evaporation from the discharge orifice increases in a liquid discharge head with flow mode A due to change in usage environment or the like, appropriately increasing the circulatory flow C allows the flow mode A to be maintained. On the other hand, in a liquid discharge head where dimensions have been set to realize flow mode B, flow mode A cannot be realized however the flow rate of the circulatory flow C is increased. Of liquid discharge heads where the flow mode A is realized, discharge heads where H is 20 μm or less, P is 20 μm or less, and W is 30 μm or less, are particularly preferable, thereby enabling higher definition image formation.

Figure 26A:
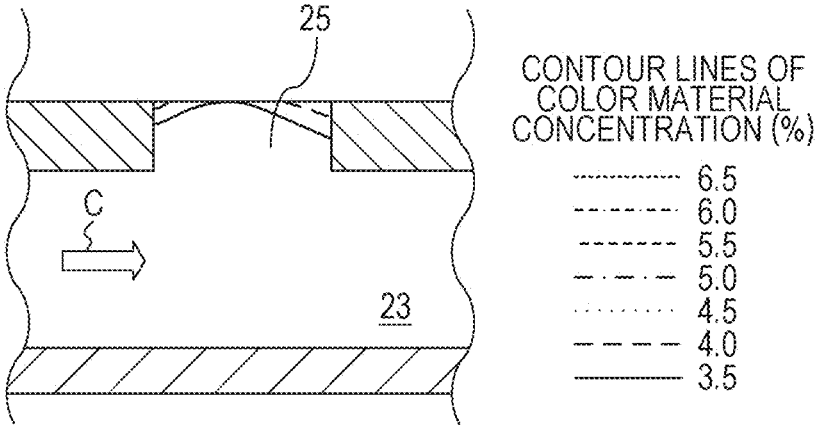
FIGS. 26A and 26B are diagrams illustrating the state of coloring material concentration of ink within a discharge channel.
Figure 26B:
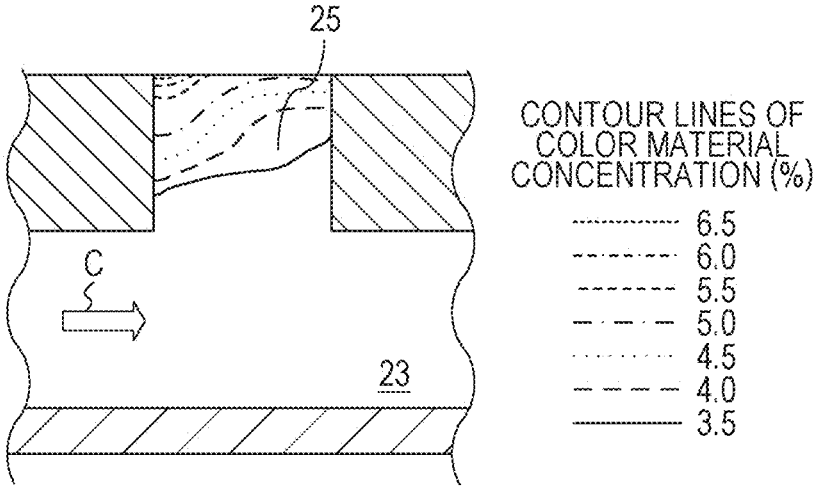

The liquid discharge head with flow mode A and the liquid discharge head with flow mode B have different states of color material concentration of ink within the discharge orifice portion 25, due to the speed component of the circulatory flow C near the middle of the discharge orifice interface 24 being different. FIGS. 26A and 26B are diagrams illustrating the states of color material concentration of ink within the discharge orifice portion 25 in liquid discharge heads with flow mode A and flow mode B, respectively. Specifically, FIGS. 26A and 26B illustrate the concentration of color material of the ink by contour lines, with regard to a case where the flow rate into the pressure chamber 23 is $1.26\times10^{-4}$ ml/min, for liquid discharge heads with flow mode A and flow mode B, respectively. FIG. 26A corresponds to a liquid discharge head where H is 14 μm, P is 5 μm, and W is 12.4 μm, while FIG. 26B corresponds to a liquid discharge head where H is 14 μm, P is 11 μm, and W is 12.4 μm.

The liquid discharge head with flow mode A illustrated in FIG. 26A has a lower concentration of color material of the ink within the discharge orifice portion 25 as compared to the liquid discharge head with flow mode B illustrated in FIG. 26B. This means that the liquid discharge head with flow mode A illustrated in FIG. 26A is moving (outflow) ink within the discharge orifice portion 25 to the pressure chamber 23, by the circulatory flow C having the positive speed component as far as the discharge orifice interface 24. Accordingly, the liquid discharge head with flow mode A can suppress stagnation of ink within the discharge orifice portion 25, and can reduce increase in concentration of color material.

Figure 27:
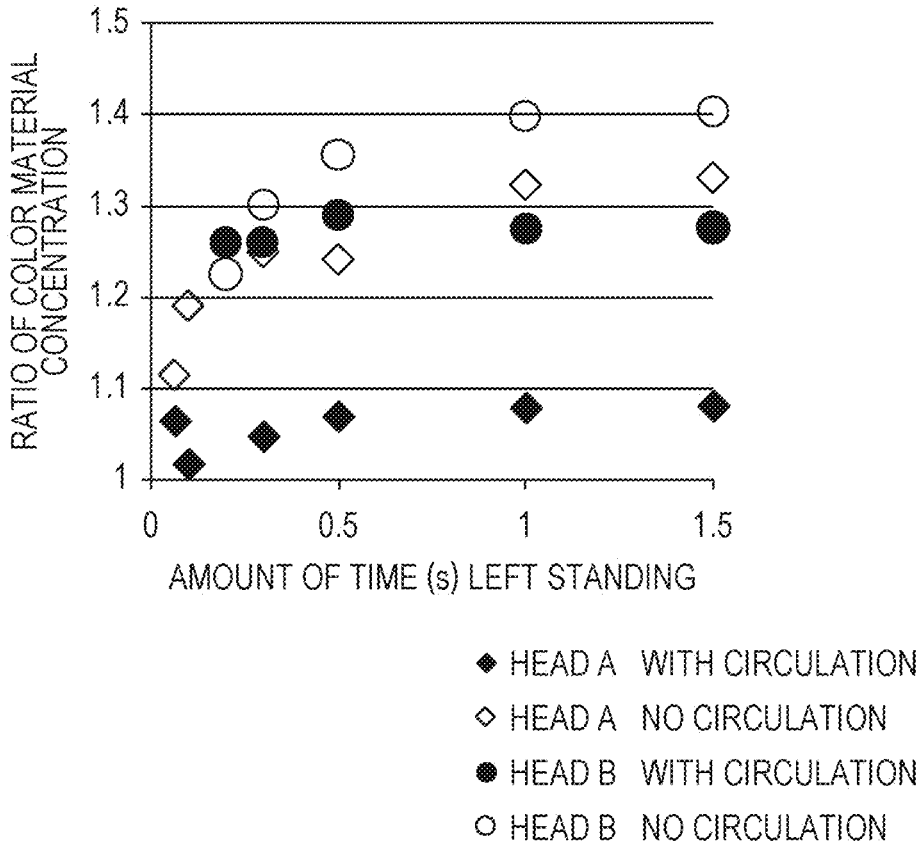
FIG. 27 is a graph illustrating the results of comparing coloring material concentration of ink on a recording medium.

FIG. 27 is a graph illustrating experimentation results comparing the color material concentration of ink discharged from the liquid discharge head with flow mode A illustrated in FIG. 26A (head A) and the liquid discharge head with flow mode B illustrated in FIG. 26B (head B). Specifically, FIG. 27 illustrates experimentation results of discharging on a recording medium with both heads, in a state where a circulatory flow C is generated in the pressure chamber 23, and in a state where no circulatory flow C is generated and ink is not flowing, and comparing the color material concentration of ink. The horizontal axis represents the amount of time left standing after discharging droplets from the discharge orifices. The vertical axis represents the ratio of color material concentration, more specifically the ratio as to concentration of a dot formed by ink discharged at a discharge frequency of 100 Hz serving as 1.

In a case where no circulatory flow C is generated, the concentration ratio after letting stand for 1 second or longer was 1.3 or more for both head A and head B, as illustrated in FIG. 27, showing that the concentration of color material of the ink rises in a short time after letting stand. On the other and, in a case where the circulatory flow C is generated, the concentration ratio was 1.3 for head B, so the increase on color material concentration was reduced as compared to a case where no circulatory flow C was generated. Still, the effects of reduction thereof are insufficient, since ink with a heightened concentration of color material has stagnated in the discharge orifice portion 25 due to evaporation of ink from the discharge orifices 13. The Present Inventors have found that color unevenness becomes difficult to visually perceive if the color material concentration ratio is around 1.2, but head B is insufficient from the point as well. In comparison with this, the color material concentration ratio at the heard A was suppressed to 1.1 or lower even after letting stand for around 1.5 seconds, reducing occurrence of color unevenness in the image. Although FIG. 27 illustrates experiment results in a case where color material concentration increases due to evaporation, the same holds true in a cases where color material concentration decreases due to evaporation.

Thus, the liquid discharge head with flow mode A can move ink within the discharge orifice portion 25, particularly ink near the discharge orifice interface 24, to the pressure chamber 23, by the circulatory flow C having the positive speed component reaching as far as the discharge orifice interface 24. Accordingly, the liquid discharge head with flow mode A can suppress stagnation of ink within the discharge orifice portion 25, and can reduce increase in concentration of color material within the discharge orifice portion 25 even if there is evaporation of ink from the discharge orifice 13. Even in a state where discharge operations are stopped, the liquid discharge head with flow mode A is constantly in a state where rise in color material concentration of the ink within the discharge orifice portion 25 is reduced, since the circulatory flow C having the positive speed component reaches as far as the discharge orifice interface 24. Accordingly, the first discharge after the intermission can be performed correctly, and occurrence of unevenness in color can be reduced.

Description of Deviation in Discharge Direction of First Discharge After Intermission Now, the color material concentration within the discharge orifice portion 25 of the liquid discharge head with flow mode A is greater at the downstream side of the circulatory flow C as illustrated in FIG. 26A, and the liquid viscosity also is higher at the downstream side. On the other hand, the color material concentration within the liquid discharge head with flow mode B is greater at the upstream side of the circulatory flow C as illustrated in FIG. 26B, and the liquid viscosity also is higher at the upstream side. Thus, there is an imbalance in the color material concentration and liquid viscosity in the liquid discharge heads of both modes, and this imbalance may cause the discharge direction of liquid to deviate from the target direction, as described below. Note that this deviation in discharge direction does not in cases where discharge is being continuously performed, since the concentration distribution and viscosity distribution within the discharge orifice portion 25 needs a certain amount of time to be formed, but is a phenomenon that occurs at the first discharge after an intermission of a certain amount of time.

Figure 28A:
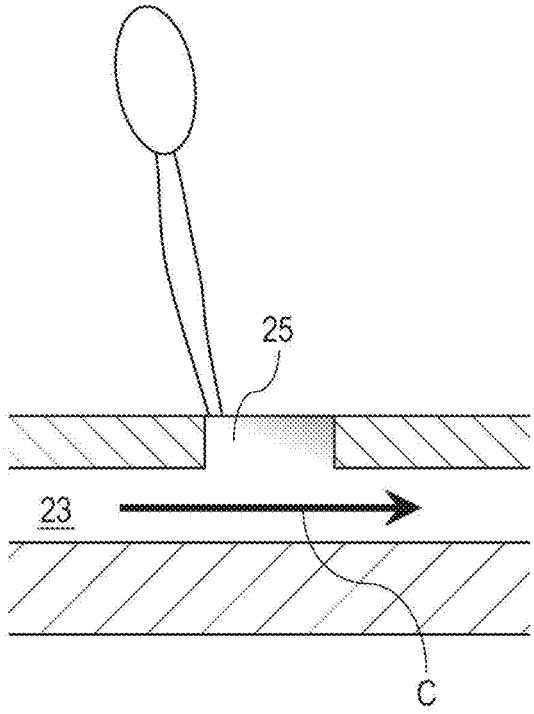
FIGS. 28A and 28B are diagrams for describing deviation of the discharge direction of liquid in a flow mode A.
Figure 28B:
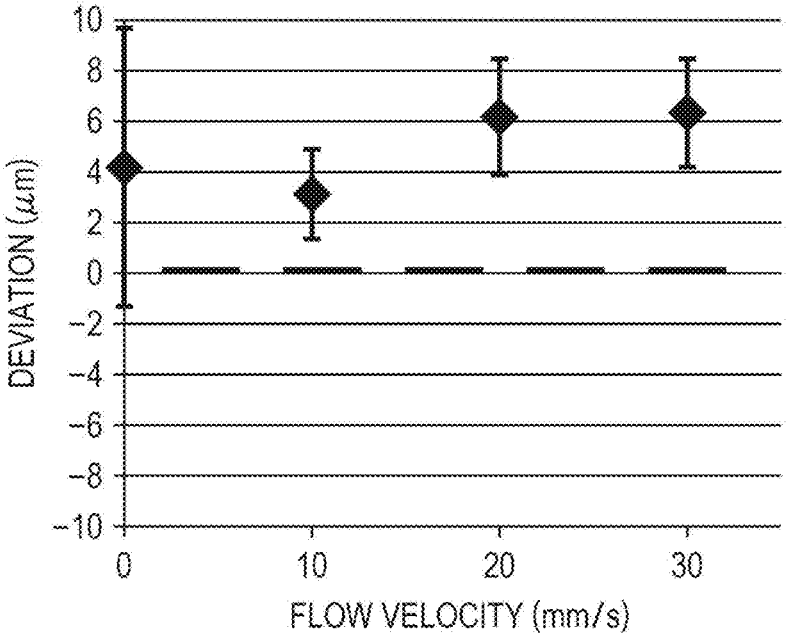

FIG. 28A is a diagram illustrating the way in which discharge direction deviation occurs in the liquid discharge head with flow mode A. FIG. 28B is a graph plotting average values of deviation from the target landing position, at different flow velocities of the circulatory flow C, in the liquid discharge head with flow mode A illustrated in FIG. 26A. The location in the discharge orifice portion 25 where the viscosity is relatively high at the downstream side in the liquid discharge head with flow mode A, so the discharge direction of the liquid may deviate toward the upstream side with regard to the direction of the circulatory flow C, as illustrated in FIG. 28A. The amount of this deviation is approximately 5 μm, for example, as illustrated in FIG. 28B.

Figure 29A:
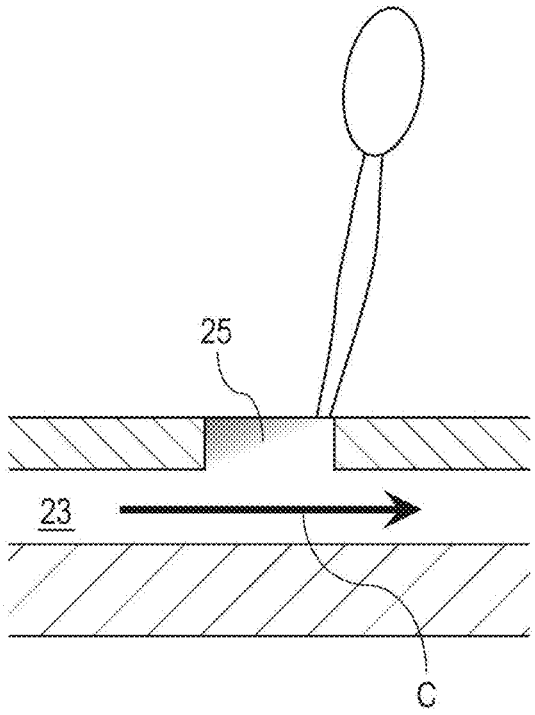
FIGS. 29A and 29B are diagrams for describing deviation of the discharge direction of liquid in a flow mode B.
Figure 29B:
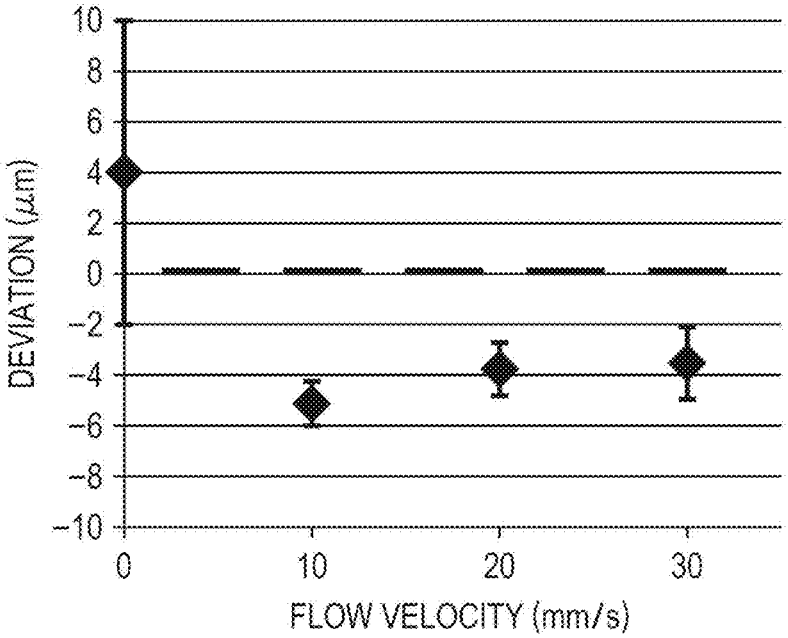

FIG. 29A is a diagram illustrating the way in which discharge direction deviation occurs in the liquid discharge head with flow mode B. FIG. 29B is a graph plotting average values of deviation from the target landing position, at different flow velocities of the circulatory flow C, in the liquid discharge head with flow mode B illustrated in FIG. 26B. The location in the discharge orifice portion 25 where the viscosity is relatively high is at the upstream side in the liquid discharge head with flow mode B, so the discharge direction of the liquid may deviate toward the downstream side with regard to the direction of the circulatory flow C, as illustrated in FIG. 29A. The amount of this deviation is approximately 5 μm, for example, as illustrated in FIG. 29B.

Figure 30A:
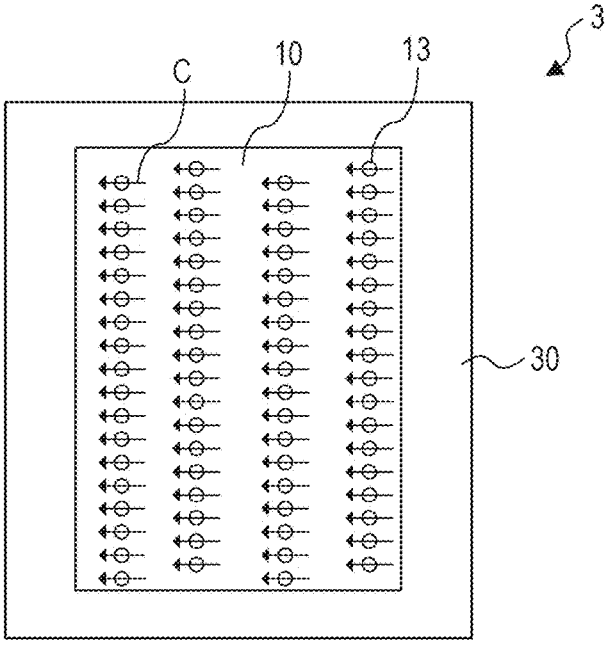
FIGS. 30A and 30B are plan views illustrating a configuration example of a liquid discharge head taking deviation of discharge direction into consideration.
Figure 30B:
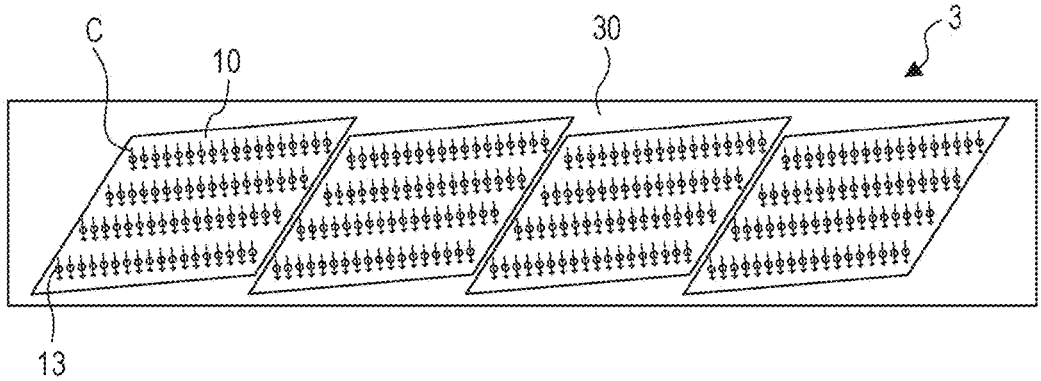

Description of Configuration of Liquid Discharge Head Taking Deviation in Liquid Discharge Direction into Consideration FIG. 30A is a plan view illustrating one configuration example of a liquid discharge head configured taking into consideration the above-described deviation in discharge direction of liquid, and FIG. 30B is a plan view illustrating another configuration example. The arrows in FIGS. 30A and 30B indicating the direction of the circulatory flow C in the pressure chambers 23 corresponding to the discharge orifices 13. Making the direction of the circulatory flow C to be the same at all discharge orifices 13 of the liquid discharge head 3 enables the deviation in discharge direction of the first discharge after intermission to be aligned. As a result, even if the discharge direction of the first discharge after the intermission is deviated, the direction of deviation is the same in all discharge orifices 13, so even when printing tables, the liens can be formed with higher quality, and images can be formed with higher definition and higher quality.

Figure 31A:
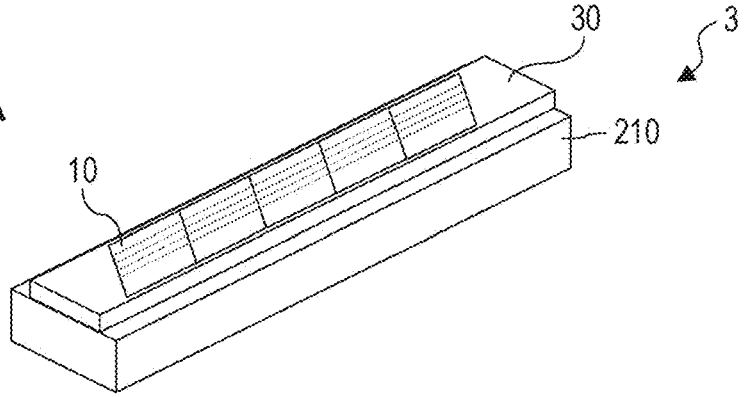
FIGS. 31A through 31D are perspective views illustrating configuration examples of a liquid discharge head including multiple recording element boards.
Figure 31B:
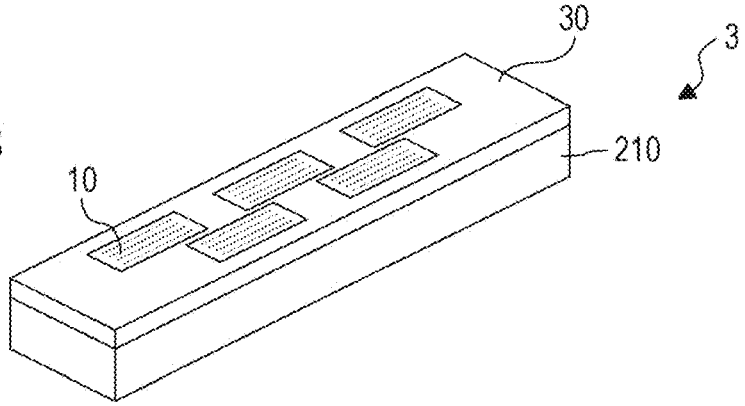
Figure 31C:
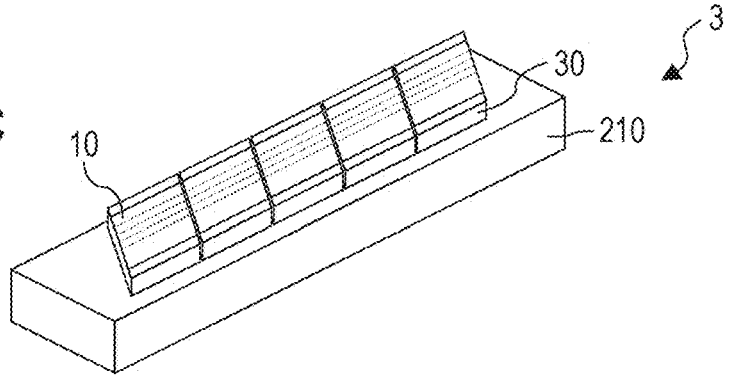
Figure 31D:
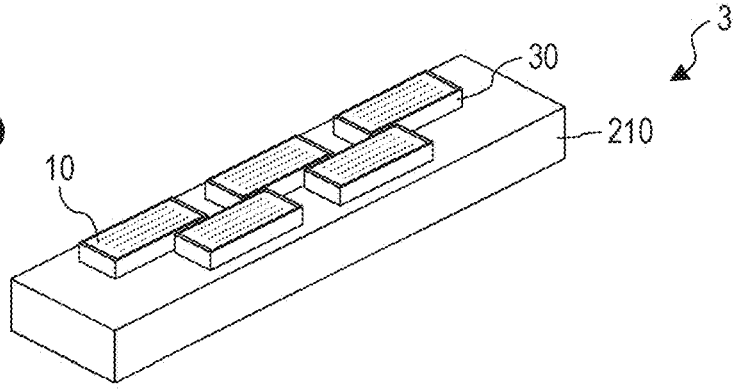

The configuration of the liquid discharge head 3 is not restricted to the examples of inline arrays illustrated in FIGS. 30A and 30B. FIG. 31A is a drawing corresponding to FIG. 30B, in which where the multiple recording element boards 10 are arrayed in a straight line. On the other hand, the multiple recording element boards 10 may be arrayed in a staggered form, as illustrated in FIG. 31B. In comparison with the arrangements in FIGS. 31A and 31B where multiple recording element boards 10 are arrayed on a single support member 30, arrangements may be made where individual recording element boards 10 are arrayed on multiple support members 30. The shapes of the main face of the recording element boards 10 may be parallelograms as illustrated in FIGS. 31A and 31C, or may be rectangles as illustrated in FIGS. 31B and 31D, as described above. The direction of the circulatory flow C is the same at all discharge orifices 13 of the liquid discharge heads 3 illustrated in each of FIGS. 31A through 31D.

Description of Slower Discharge Speed of First Discharge After Intermission

Figure 32:
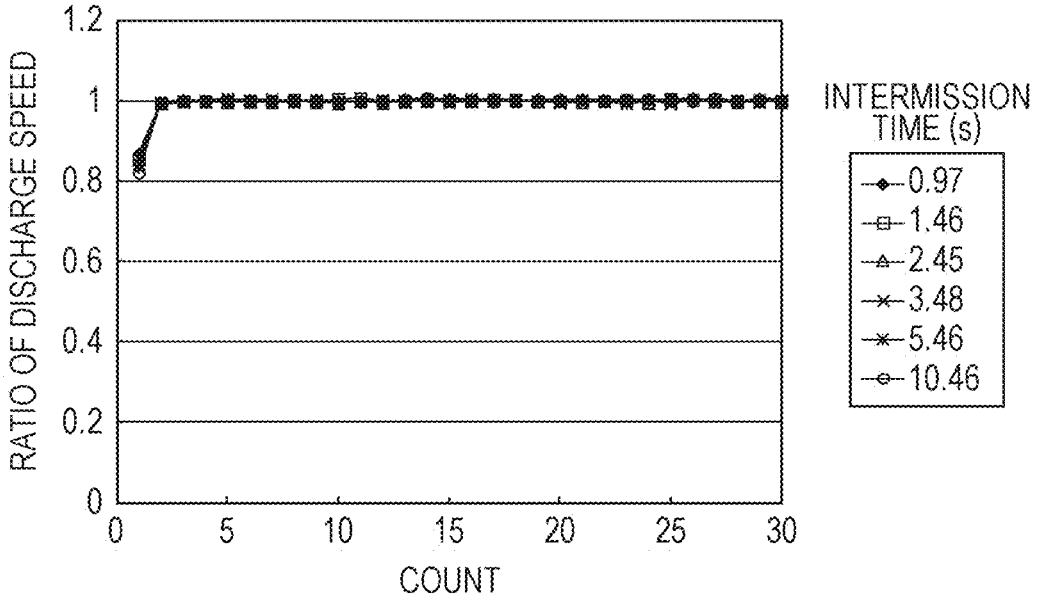
FIG. 32 is a graph where discharge speed as to the count of discharges after an intermission has been plotted.

FIG. 32 is a graph, where the intermission time in discharge operations of a liquid discharge head with flow mode A illustrated in FIG. 26A is changed variously, and the discharge speeds corresponding to the count of discharges after the intermission are plotted. Specifically, the vertical axis represents the ratio of speed, where an average value of discharge speed of the tenth through thirtieth discharges after the intermission is set as 1. It can be seen form FIG. 32 that from the second discharge on after the intermission, the discharge speed approximately matches the discharge speed when continuously discharging, but the discharge speed of the first discharge after the intermission is slightly slower. This is due to stopping discharging operations making the viscosity of the liquid within the discharge orifice portion 25 slightly greater than that in the pressure chamber 23, as described above. This deterioration in discharge speed does not in occur cases where discharge is being continuously performed, since the concentration distribution of color material (viscosity of liquid) within the discharge orifice portion 25 needs a certain amount of time to be formed, but is a phenomenon that occurs at the first discharge after an intermission of a certain amount of time, in the same way as with the above-described deviation in discharge direction. This deterioration in discharge speed occurs in liquid discharge heads with the flow mode B in the same way.

Description of Liquid Discharge Head Taking Into Consideration Relative Movement Direction as to Recording Medium If the discharge speed of the first discharge following the intermission is slower in comparison with continuously discharging, this means that the actual landing position on the recording medium will deviate from the target landing position. This direction of deviation is consistently toward the upstream side in the relative movement direction of the recording medium as to the liquid discharge head (hereinafter also referred to simply as "movement direction"). On the other hand, the deviation in landing position due to the deviation in discharge direction of the like differs depending on the relationship between the direction of deviation of discharge and the direction in which the recording medium is moving. The direction of deviation of discharge also differs depending on the type of flow mode as described above. This is toward the upstream side of the circulatory flow C in liquid discharge heads with flow mode A, and toward the downstream side of the circulatory flow C in liquid discharge heads with flow mode B. Accordingly, by appropriately setting the moving direction of the recording medium in accordance with the type of flow mode, deviation in landing position due to slower discharge speed and deviation in landing position due to deviation in discharge direction can be almost completely cancelled out.

Figure 33A:
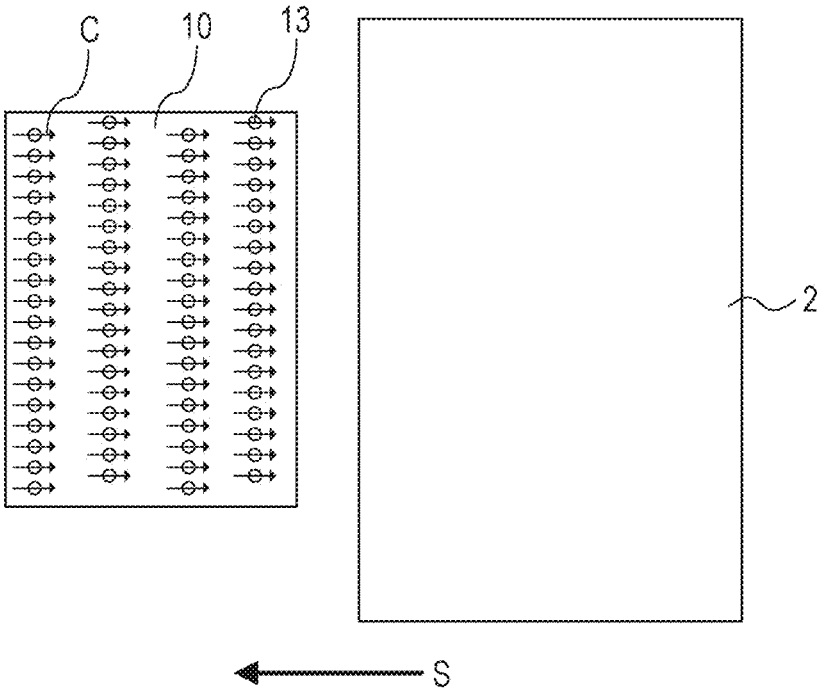
FIGS. 33A and 33B are diagrams illustrating the relationship between circulatory flow and recording medium in flow mode A.
Figure 33B:
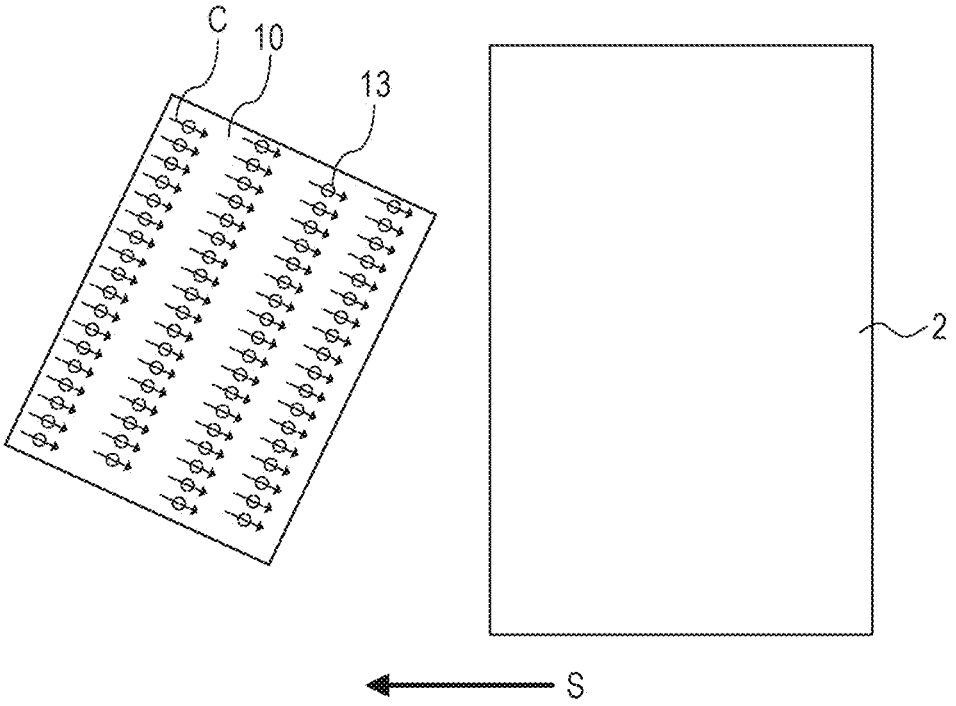

FIGS. 33A and 33B are diagrams illustrating the relationship between the circulatory flow C in the pressure chambers 23 of a liquid discharge head with flow mode A, and the relative movement direction of the liquid discharge head as to the recording medium. The liquid discharge head with flow mode A has the direction of the circulatory flow C in the pressure chambers 23 and the conveyance direction S of the recording medium 2 set in opposite directions. The term "opposite directions" as used here is not restricted to completely opposite directions as illustrated in FIG. 33A, but rather means that when performing vector decomposition of the circulatory flow C with regard to the movement direction S of the recording medium 2, the circulatory flow C has a component that is in the opposite direction from a component of the movement direction S.

The deviation in discharge direction of the first discharge after the intermission is toward the upstream side of the circulatory flow C in the liquid discharge head with flow mode A illustrated in FIGS. 33A and 33B, as described above. Accordingly, the deviation in landing position due to this deviation is toward the downstream direction in the movement direction S. On the other hand, the deviation in landing position due to slower discharge speed of the first discharge after the intermission is toward the upstream side in the moving direction S, as described above. Accordingly, the deviation in landing position due to the deviation in discharge direction and the deviation in landing position due to the slower discharge speed cancel each other out, so ink can be made to land near the target landing position in the first discharge after the intermission.

Figure 34A:
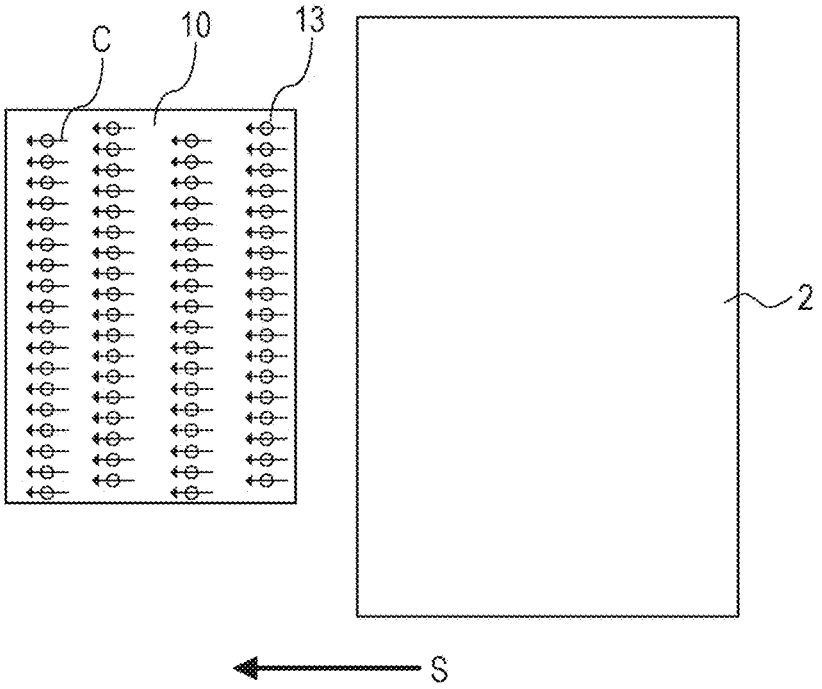
FIGS. 34A and 34B are diagrams illustrating the relationship between circulatory flow and recording medium in flow mode B.
Figure 34B:
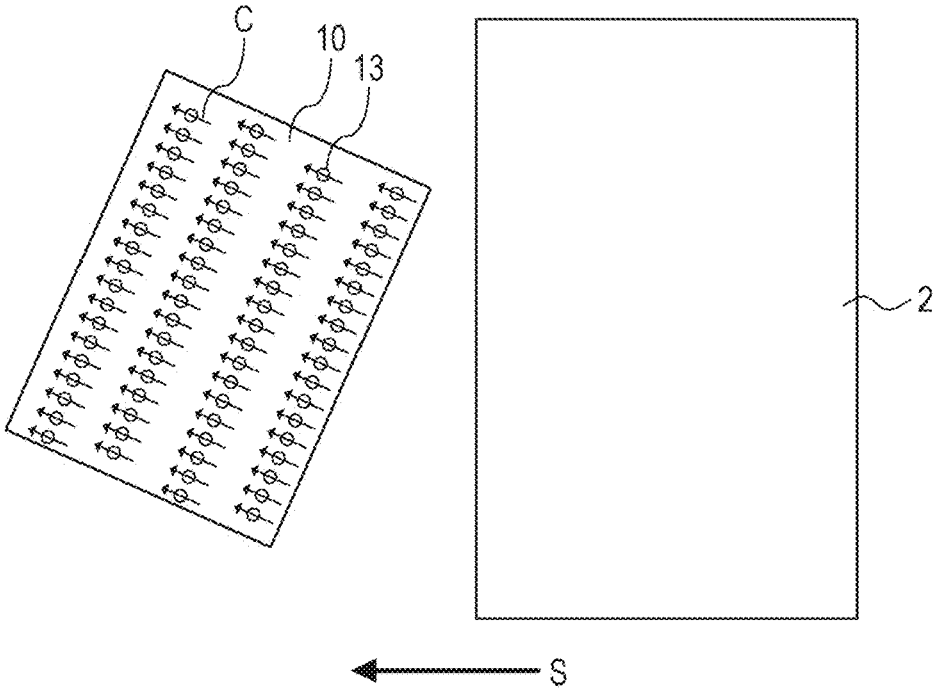

FIGS. 34A and 34B are diagrams illustrating the relationship between the circulatory flow C in the pressure chambers 23 of a liquid discharge head with flow mode B, and the relative movement direction of the liquid discharge head as to the recording medium. The liquid discharge head with flow mode B has the direction of the circulatory flow C in the pressure chambers 23 and the conveyance direction S of the recording medium 2 set in the same direction. The term "same direction." as used here is not restricted to completely the same direction as illustrated in FIG. 34A, but rather means that when performing vector decomposition of the circulatory flow C with regard to the movement direction S of the recording medium 2, the circulatory flow C has a component that is in the same direction from a component of the movement direction S.

The deviation in discharge direction of the first discharge after the intermission is toward the downstream side of the circulatory flow C in the liquid discharge head with flow mode B illustrated in FIGS. 34A and 34B, as described above. Accordingly, the deviation in landing position due to this deviation is toward the upstream direction in the movement direction S. On the other hand, the deviation in landing position due to slower discharge speed of the first discharge after the intermission is toward the upstream side in the moving direction S, as described above. Accordingly, the deviation in landing position due to the deviation in discharge direction and the deviation in landing position due to the slower discharge speed cancel each other out, so ink can be made to land near the target landing position in the first discharge after the intermission.

As described above, setting the movement direction of the recording medium in accordance with the type of flow mode enables disarray in landing position due to change in discharge speed and disarray in discharge direction occurring at the first discharge after intermission to be reduced, and thereby form images with even higher definition and higher quality.

This method is particularly effective regarding liquid discharge heads configured to perform temperature adjustment of the substrate 11. That is to say, adjusting the temperature of the substrate 11 enables change in discharge speed and change in discharge amount occurring due to temperature change of the substrate 11 to be suppressed, but if the temperature of the liquid rises, the amount of evaporation of liquid from the discharge orifices 13 increases, and the concentration distribution within the discharge orifice portion 25 becomes more imbalanced. As a result, there are cases where the deviation in discharge direction and slower discharge speed at the first discharge after the intermission, the direction of movement of the recording medium is appropriately set in accordance with the type of flow mode, so the disarray in landing position due to each of these can be made to cancel each other out. The recording elements 15 use to discharge ink can also be used as temperature adjusters to adjust the temperature of the substrate 11, and further, separate heaters for temperature adjustment may also be provided.

This sort of method is also applicable to a serial-type liquid discharge head as well, in which case the direction of the circulatory flow C can be reversed in accordance with the scan direction of the liquid discharge head. Examples of methods for reversing the direction of the circulatory flow C include reversing pressure difference between two tanks, and reversing the rotation direction of pumps.

According to an embodiment of the present invention, a liquid discharge head capable of forming high definition and high quality images can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-002958, filed Jan. 8, 2016, and Japanese Patent Application No. 2016-238632, filed Dec. 8, 2016, which are hereby incorporated by reference herein in their entirety.

What is claimed is:

1. A liquid discharge head comprising:

a recording element board including, first and second discharge orifice rows where discharge orifices configured to discharge liquid are arrayed, first and second pressure chamber rows provided corresponding to the first and second discharge orifice rows, and having recording elements configured to generate energy used to discharge liquid, a first liquid supply channel provided along the first discharge orifice row and configured to supply liquid to the first pressure chamber row and a first liquid recovery channel provided along the first discharge orifice row, separated from the first liquid supply channel, and configured to recover liquid from the first pressure chamber row, a second liquid supply channel provided along the second discharge orifice row and configured to supply liquid to the second pressure chamber row and a second liquid recovery channel provided along the second discharge orifice row, separated from the second liquid supply channel, and configured to recover liquid from the second pressure chamber row, wherein a direction of flow of liquid within each of the plurality of pressure chambers included in the first and second pressure chamber rows, from the liquid supply channel via the pressure chamber and to the liquid recovery channel, is the same direction wherein the liquid discharge head executes liquid discharging while causing the liquid to circulate in one direction in an order of, the outside of the pressure chambers, the liquid supply channel, the pressure chamber, the liquid recovery channel, and the outside of the pressure chambers, during a recording process, wherein a discharge orifice portion is provided communicating with the discharge orifices and the pressure chamber, wherein, in a case of satisfying $$H^{-0.34} \times P^{-0.66} \times W > 1.7$$

wherein H represents a height of the pressure chamber at an upstream side from a communicating portion with the discharge orifice portion in the direction of flow of the liquid, P represents a length of the discharge orifice portion in a direction of discharge of the liquid, and W represents a length of the discharge orifice portion in the direction of flow of the liquid that corresponds to a width of the first and the second liquid supply channels, and wherein the direction of flow of liquid flowing inside each of the first and second pressure chambers is in a x-y axis direction and is opposite a feeding direction of a recording medium.

2. A liquid discharge head comprising:

a recording element board including, first and second discharge orifice rows where discharge orifices configured to discharge liquid are arrayed, first and second pressure chamber rows provided corresponding to the first and second discharge orifice rows, and having recording elements configured to generate energy used to discharge liquid, a first liquid supply channel provided along the first discharge orifice row and configured to supply liquid to the first pressure chamber row and a first liquid recovery channel provided along the first discharge orifice row, separated from the first liquid supply channel, and configured to recover liquid from the first pressure chamber row, a second liquid supply channel provided along the second discharge orifice row and configured to supply liquid to the second pressure chamber row and a second liquid recovery channel provided along the second discharge orifice row, separated from the second liquid supply channel, and configured to recover liquid from the second pressure chamber row, wherein a direction of flow of liquid within each of the plurality of pressure chambers included in the first and second pressure chamber rows, from the liquid supply channel via the pressure chamber and to the liquid recovery channel, is the same direction wherein the liquid discharge head executes liquid discharging while causing the liquid to circulate in one direction in an order of, the outside of the pressure chambers, the liquid supply channel, the pressure chamber, the liquid recovery channel, and the outside of the pressure chambers, during a recording process, wherein a discharge orifice portion is provided communicating with the discharge orifices and the pressure chamber, and wherein, in a case of satisfying $$H^{-0.34} \times P^{-0.66} \times W \leq 1.7$$

wherein H represents a height of the pressure chamber at an upstream side from a communicating portion with the discharge orifice portion in the direction of flow of the liquid, P represents a length of the discharge orifice portion in a direction of discharge of the liquid, and W represents a length of the discharge orifice portion in the direction of flow of the liquid that corresponds to a width of the first and the second liquid supply channels, and wherein, the direction of flow of liquid flowing inside each of the first and second pressure chambers is in a x-y axis direction and is the same direction as a feeding direction of a recording medium.

3. The liquid discharge head according to claim 1, wherein the recording element board includes a discharge orifice forming member having the discharge orifices, and a substrate having the recording elements.

4. The liquid discharge head according to claim 1, further comprising:

a first supply port row where a plurality of first supply ports, configured to supply liquid to the first pressure chamber row from the first liquid supply channel, are arrayed, and a first recovery port row where a plurality of first recovery ports, configured to recover liquid from the first pressure chamber row to the first liquid recovery channel, are arrayed, and a second supply port row where a plurality of second supply ports, configured to supply liquid to the second pressure chamber row from the second liquid supply channel, are arrayed, and a second recovery port row where a plurality of second recovery ports, configured to recover liquid from the second pressure chamber row to the second liquid recovery channel, are arrayed, wherein the first and second liquid supply channels, and the first and second liquid recovery channels, each extend in the direction in which the first discharge orifice row extends, and wherein the first and second supply ports, and the first and second recovery ports, each extend in a direction intersecting a face of the substrate on which the recording elements are disposed.

5. The liquid discharge head according to claim 3, wherein the first and second supply ports, and the first and second recovery ports, each extend in a direction intersecting a face of the substrate on which the recording elements are disposed.

6. The liquid discharge head according to claim 1, wherein the recording elements are heat-generating elements configured to generate thermal energy used to discharge liquid.

7. The liquid discharge head according to claim 1, wherein a flow velocity of liquid flowing through the pressure chambers, from the liquid supply channels via the pressure chambers to the liquid recovery channels, is 0.1 to 100 mm/s.

8. The liquid discharge head according to claim 1, wherein the first and second discharge orifice rows discharge liquid of different types from each other.

9. The liquid discharge head according to claim 1, wherein the first and second discharge orifice rows each discharge liquid of the same type.

10. The liquid discharge head according to claim 1, further comprising:

a plurality of the recording element boards; and a channel member configured to support the plurality of recording element boards, the channel member including a common supply channel configured to supply liquid to the plurality of recording element boards, and a common recovery channel configured to recover liquid from the plurality of recording element boards, wherein the liquid discharge head is a page-wide liquid discharge head.

11. The liquid discharge head according to claim 10, wherein the plurality of recording element boards are arrayed in a straight line.

12. The liquid discharge head according to claim 10, wherein the outline shape of each of the plurality of recording element boards is a parallelogram.

* * * * *